US005435659A

United States Patent [19]

Ueno

[11] Patent Number: 5,435,659

[45] Date of Patent: Jul. 25, 1995

[54] SCALE PRINTING APPARATUS

[75] Inventor: Hideo Ueno, Nagoya, Japan

[73] Assignee: Brother Kogyo Kabushiki Kaisha, Nagoya, Japan

[21] Appl. No.: 92,492

[22] Filed: Jul. 16, 1993

[30] Foreign Application Priority Data

Sep. 1, 1992 [JP] Japan ..... 4-258925
Sep. 3, 1992 [JP] Japan ..... 4-263066

[51] Int. Cl.[6] ..... B41J 15/00

[52] U.S. Cl. ..... 400/615.2; 101/73; 33/483

[58] Field of Search ..... 400/615.2, 17, 65; 101/73, 74, 75; 33/679.1, 483

[56] References Cited

U.S. PATENT DOCUMENTS 4,135,447 1/1979 Barnes ..... 101/74
5,066,152 11/1991 Kuzuya et al. ..... 400/621
5,230,572 7/1993 Hirono et al. ..... 400/615.2

FOREIGN PATENT DOCUMENTS 0160271 11/1985 European Pat. Off. ..... 33/483
0364305 4/1990 European Pat. Off. ..... 400/615.2
0497352 8/1992 European Pat. Off. ..... 400/615.2
140801 6/1986 Japan ..... 400/16
33784 2/1992 Japan ..... 400/16

*Primary Examiner*—David A. Wiecking
*Assistant Examiner*—Steven S. Kelley
*Attorney, Agent, or Firm*—Oliff & Berridge

[57] ABSTRACT

A tape printer in which, if prior to printing, a scale print key is operated, a scale data setting process is carried out to input and establish a plurality of setting data about the scale length, pitch and other print conditions. The scale data setting process is followed by a scale printing process executed in accordance with the setting data. This permits printing of a scale having the designated length and pitch onto the printing tape to include those to which a scaling factor has been applied.

20 Claims, 27 Drawing Sheets

Fig.10

22

«SCALE LENGTH SETTING»
200mm

Fig.11

22

«GRADUATION LINE PITCH SETTING»
PITCH: mm LARGE: 10 MEDIUM: 5 SMALL: 1

Fig.12

22

«DIVISION NUMERAL SETTING»
LARGE: cm MEDIUM: OFF SMALL: OFF

Fig.16

22

«CORRECTION FACTOR SETTING»
CORRECTION FACTOR = 1.05

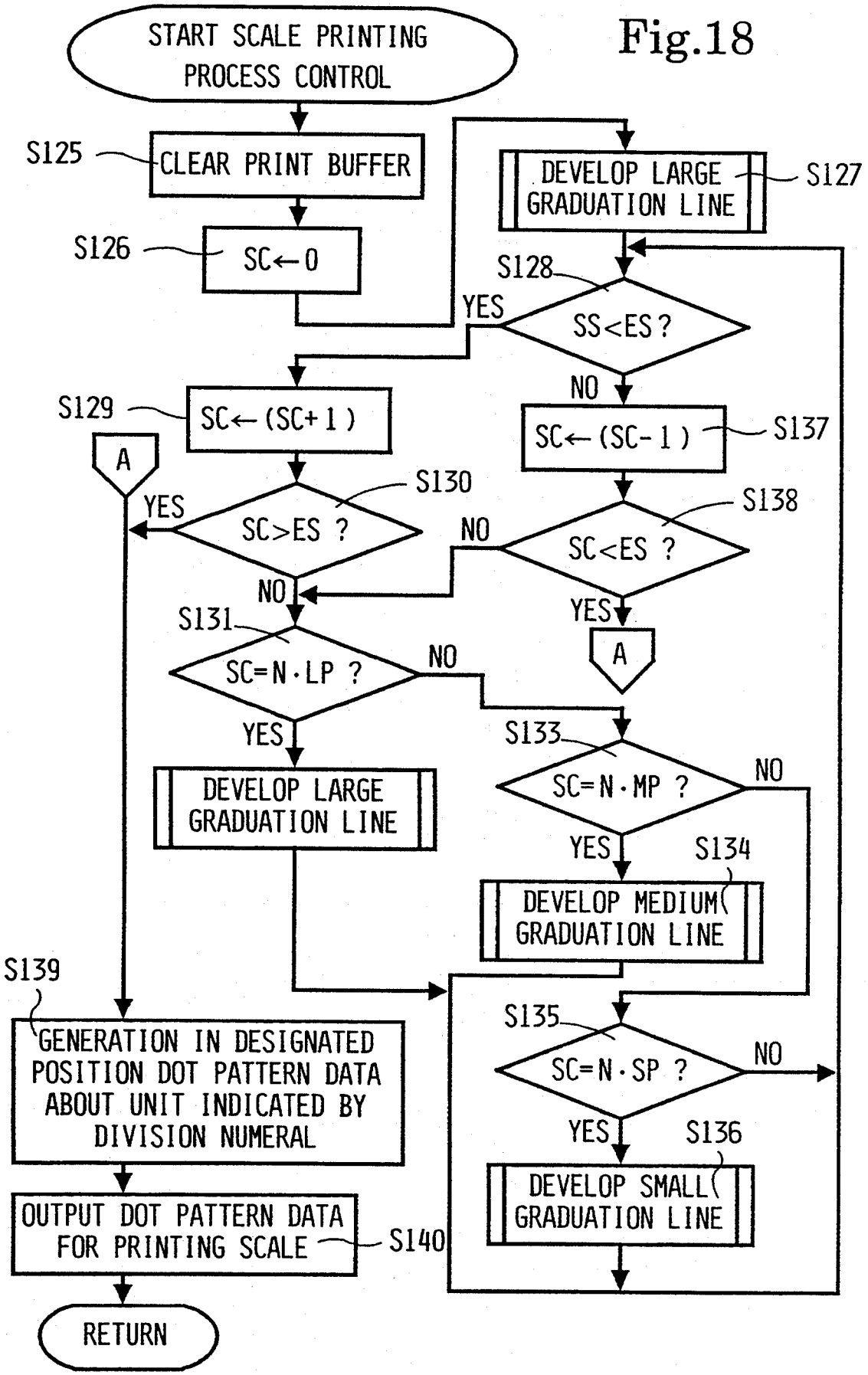
Fig.18
START SCALE PRINTING PROCESS CONTROL
S125
CLEAR PRINT BUFFER
S126
SC←0
S127
DEVELOP LARGE GRADUATION LINE
S128
SS<ES ?
YES
NO
S129
SC←(SC+1)
S137
SC←(SC-1)
A
S130
SC>ES ?
YES
NO
S138
SC<ES ?
NO
YES
A
S131
SC=N·LP ?
NO
YES
S133
SC=N·MP ?
NO
YES
S134
DEVELOP MEDIUM GRADUATION LINE
DEVELOP LARGE GRADUATION LINE
S139
GENERATION IN DESIGNATED POSITION DOT PATTERN DATA ABOUT UNIT INDICATED BY DIVISION NUMERAL
S135
SC=N·SP ?
NO
YES
S136
DEVELOP SMALL GRADUATION LINE
OUTPUT DOT PATTERN DATA FOR PRINTING SCALE
S140
RETURN

Fig. 19

22

«SCALE RANGE SETTING»
START-OF-SCALE DIVISION: 600mm
END-OF-SCALE DIVISION: 300mm

Fig. 29

122

«SCALING FACTOR SETTING»
FACTOR: 1/100000

Fig. 30

122

«SCALE LENGTH SETTING»
30Km x 100m

Fig. 31

122

«MINIMUM GRADUATION LINE PITCH»
LARGE: 10 MEDIUM: 5 SMALL: 1

Fig. 32

122

«DIVISION NUMERAL SETTING»
LARGE: x10 MEDIUM: OFF SMALL: OFF

SCALE PRINTING APPARATUS

BACKGROUND OF THE INVENTION

1. Field of the Invention

The invention relates to a scale printing apparatus arranged to print the graduation lines of a scale onto a tape.

2. Description of the Related Art

Scales such as measuring tapes and yardsticks are used in diverse applications: measuring the lengths and sizes of articles, adding scaling factor indications to maps, furnishing magnification indications to photographs taken by microscope, and providing the scale onto a column or wall against which people are casually measured for height. There have yet to be commercialized apparatuses for readily reproducing scales for personal use. When creating or recording a scale on a recording medium, an individual must get a ready-made scale copied by copier or transcribe the graduation lines of a scale manually.

Meanwhile, there is commercialized, as disclosed in U.S. Pat. No. 5,066,152, a tape printing apparatus for printing, in dot patterns, previously stored characters and symbols onto a tape used as a printing medium.

As outlined, there have yet to be introduced personal-use apparatuses that would allow individuals to create or reproduce scales in an efficient and inexpensive manner. Diverting a ready-made scale for other uses by cutting it to appropriate size is possible but troublesome and costly. Getting a scale copied by copier is subject to the length limit of the copier and suitable only for duplication on paper. Transcribing the graduation lines of a scale manually is a tedious task that often results in poor workmanship and accuracy.

The conventional tape printing apparatuses can only print characters and symbols onto tape. They are incapable of generating scales.

SUMMARY OF THE INVENTION

It is therefore an object of the invention to provide a scale printing apparatus capable of printing the graduation lines of a scale onto a tape used as a printing medium.

In carrying out the invention and according to one aspect thereof, there is provided, a printing apparatus comprising: input means for inputting characters, symbols and various commands; print means including a print head for printing dot patterns onto a tape used as a printing medium; input data storage means for storing the data representing the characters and symbols input from the input means; display means including a display device for displaying characters and symbols; a print buffer for accommodating dot pattern data for printout; print control means for receiving data from the print buffer and for ordering the print means to print the received data; data setting means for inputting setting data about scales; and scale data generating means for receiving the setting data from the data setting means in order to generate the dot pattern data for printing at least graduation lines of a scale and to feed the dot pattern data to the print buffer.

In a preferred structure according to the invention, the scale data generating means generates the dot pattern data representing the set length of a scale. In another preferred structure according to the invention, the data setting means sets the graduation line pitch of a scale, and the scale data generating means generates the dot pattern data representing the graduation line pitch. In a further preferred structure according to the invention, the data setting means sets small, medium and large graduation line pitches of scales.

In a yet further preferred structure according to the invention, the data setting means determines if division numerals are to be printed in conjunction with any one of the small, medium and large graduation line pitches and sets the print positions of the division numerals, and the scale data generating means generates the dot pattern data, including the data for printing the division numerals, to the print positions established in conjunction with the graduation lines for which the necessity of the division numerals is designated. In another preferred structure according to the invention, the data setting means sets the units for the lengths indicated by division numerals and designates the print positions in which to print the units, and the scale data generating means generates the dot pattern data including the data for printing the set units in the designated print positions.

According to another aspect of the invention, there is provided a scale printing apparatus comprising: input means for inputting characters, symbols and various commands; print means including a print head for printing dot patterns onto a tape used as a printing medium; input data storage means for storing the data representing the characters and symbols input from the input means; display means including a display device for displaying characters and symbols; a print buffer for accommodating dot pattern data for printout; print control means for receiving data from the print buffer and for ordering the print means to print the received data; graduation line data storage means for receiving and storing beforehand the dot pattern data for printing the graduation lines of a plurality of scales, the dot pattern data corresponding to a basic length repeatable on each scale; data setting means for inputting a plurality of setting data about the scales; and scale data generating means for receiving the setting data from the data setting means and for reading from the graduation line data storage means the dot pattern data corresponding to the basic length in order to combine the two kinds of data repeatedly, thereby generating the dot pattern data about the graduation lines of a selected scale and supplying the print buffer therewith.

As described, the scale printing apparatus comprises the input means, the print means including the print head, the input data storage means, the display means including the display device, the print buffer, the print control means for ordering the print means to print the data in the print buffer, the data setting means, and the scale data generating means. The apparatus is capable of printing characters and symbols in dot patterns onto a tape used as a printing medium.

When the data setting means inputs and establishes a plurality of setting data about the scale, the scale data generating means receives the setting data from the data setting means. The scale data generating means turns the received data into the dot pattern data for printing at least the graduation lines of the scale, and supplies the dot pattern data to the print buffer. The data held in the print buffer are printed onto the tape by the print means controlled by the print control means. In this manner, it is possible to print scales made of accurate and orderly graduation lines onto the tape easily and inexpensively.

Alternatively, the scale printing apparatus prints scales to any length desired. The scale printing apparatus prints scales at the pitch equivalent to that of the graduation lines. The apparatus allows the pitches to be set as desired for the small, medium and large graduation lines. The scale is then printed with its small, medium and large graduation lines set as desired in pitch. The scale printing apparatus prints division numerals to any of the small, medium and large graduation lines in predetermined positions. In printing scales, the scale printing apparatus prints the length units indicated by division numerals in the print positions designated.

The scale printing apparatus prints characters and symbols in dot patterns onto a tape used as a printing medium. The graduation line data storage means stores in advance the dot pattern data for printing graduation lines of a plurality of scales, the data representing basic lengths repeatable on each scale. When the data setting means is used to input a plurality of setting data about a scale, the scale data generating means receives the setting data from the data setting means. Then the dot pattern data representing the basic length of the scale are read from the graduation line data storage means and are repeatedly combined. This generates the dot pattern data about the graduation lines of the designated scale, and the data are fed to the print buffer. The print means under control of the print control means prints onto the tape the data retrieved from the print buffer. As a result, the scale is printed as designated along with its graduation lines.

BRIEF DESCRIPTION OF THE DRAWINGS

The invention will be described with reference to the drawings in which:

FIG. 10 is a view of a typical scale length setting screen;

FIG. 11 is a view of a typical graduation line pitch setting screen;

FIG. 12 is a view of a typical division numeral setting screen;

FIG. 16 is a view of a typical correction factor setting screen;

FIG. 18 is a flowchart of another scale printing process control routine;

FIG. 19 is a view of a typical scale range setting screen;

FIG. 29 is a view of a typical scaling factor setting screen;

FIG. 30 is a view of a typical scale length setting screen;

FIG. 31 is a view of a typical graduation line pitch setting screen;

FIG. 32 is a view of a typical division numeral setting screen;

DETAILED DESCRIPTION OF THE PREFERRED EMBODIMENTS

One preferred embodiment of the invention will now be described with reference to the accompanying drawings. The embodiment is a Japanese-language tape printing apparatus capable of printing numerous characters including kanji characters, hiragana characters, alphabetic characters and symbols onto a printing tape. The application is not limited to a Japanese language tape printing apparatus, although it will be explained in such a context.

Figure 1:
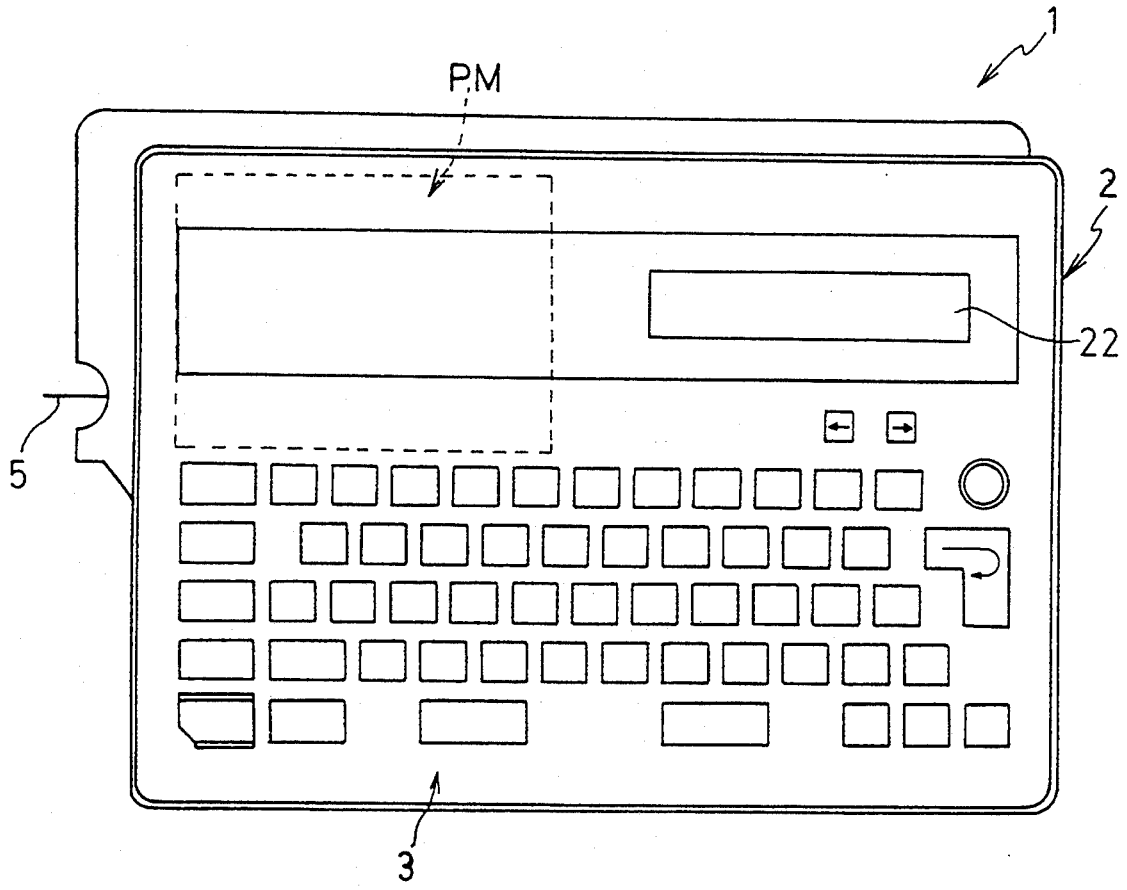
FIG. 1 is a plan view of a tape printing apparatus embodying the invention.

As shown in FIG. 1, a keyboard 3 is disposed in the front part of a frame 2 of the tape printing apparatus 1. At the back of the keyboard 3 and inside the frame 2 is a print mechanism PM. Also at the back of the keyboard 3 is a liquid-crystal display (LCD) 22 capable of displaying characters and symbols.

The keyboard 3 comprises character keys for inputting alphabetic characters, hiragana characters, numerals and symbols; a space key; a return key; cursor movement keys for moving a cursor K back and forth on the LCD 22; a format setting key for setting a print format; a size setting key for setting the size of print characters; a font setting key for setting the font of print characters; a text print key for designating the printing of text; a scale print key for designating scale printing; a tape feed key for feeding a printing tape 5; and a power key for turning on and off power.

Figure 2:
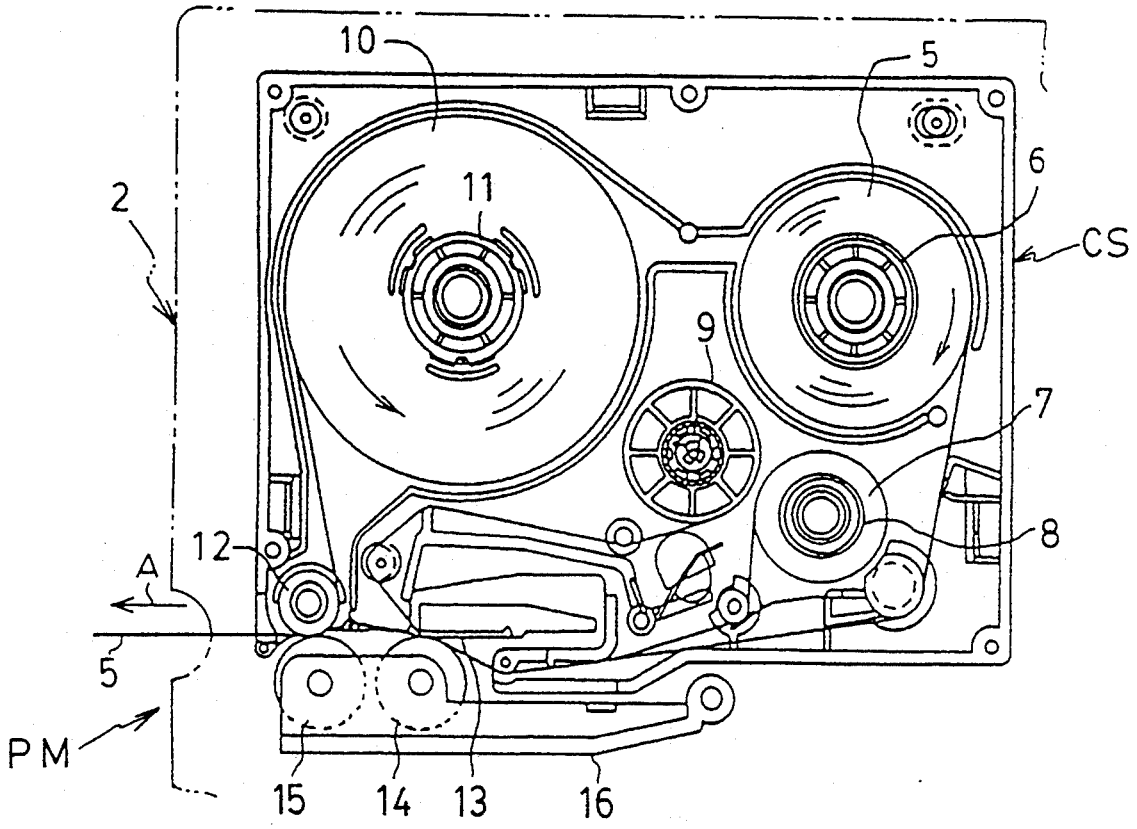
FIG. 2 is a schematic plan view of the print mechanism in the embodiment.

Below is a brief description of the print mechanism PM with reference to FIG. 2. A rectangular tape-storage cassette CS is loaded removably in the print mechanism PM. The tape-storage cassette CS contains a tape spool 6 around which the printing tape 5 about 18 mm wide is wound; a ribbon feed spool 8 around which an ink ribbon 7 is wound; a take-up spool 9 that takes up the ink ribbon 7; a feed spool 11 around which an adhesive double-coated tape 10 is wound with its peeling sheet facing outward; and a bonding roller 12 that bonds the printing tape 5 to the adhesive double-coated tape 10. The roller and the spools are furnished rotatably.

A thermal head 13 is positioned where the printing tape 5 and the ink ribbon 7 overlap. A platen roller 14 and a feed roller 15 are attached pivotably to a support body 16. The platen roller 14 presses the printing tape 5 and ink ribbon 7 against the thermal head 13, and the feed roller 15 pushes the printing tape 5 and adhesive double-coated tape 10 against the bonding roller 12. The thermal head 13 has a group of 128 heating elements arranged vertically thereon.

In operation, driving a tape feed motor 24 (see FIG. 3) in a predetermined direction rotates in synchronism the bonding roller 12 and the take-up spool 9 in their respective predetermined directions. Then energizing the heating elements prints characters and symbols in a plurality of dot columns onto the printing tape 5. The printing tape 5 is fed in the arrowed direction A shown in FIG. 2 while being bonded to the adhesive double-coated tape 10. The print mechanism PM is described in detail in European Patent Publication No. 0364305 A2.

Figure 3:
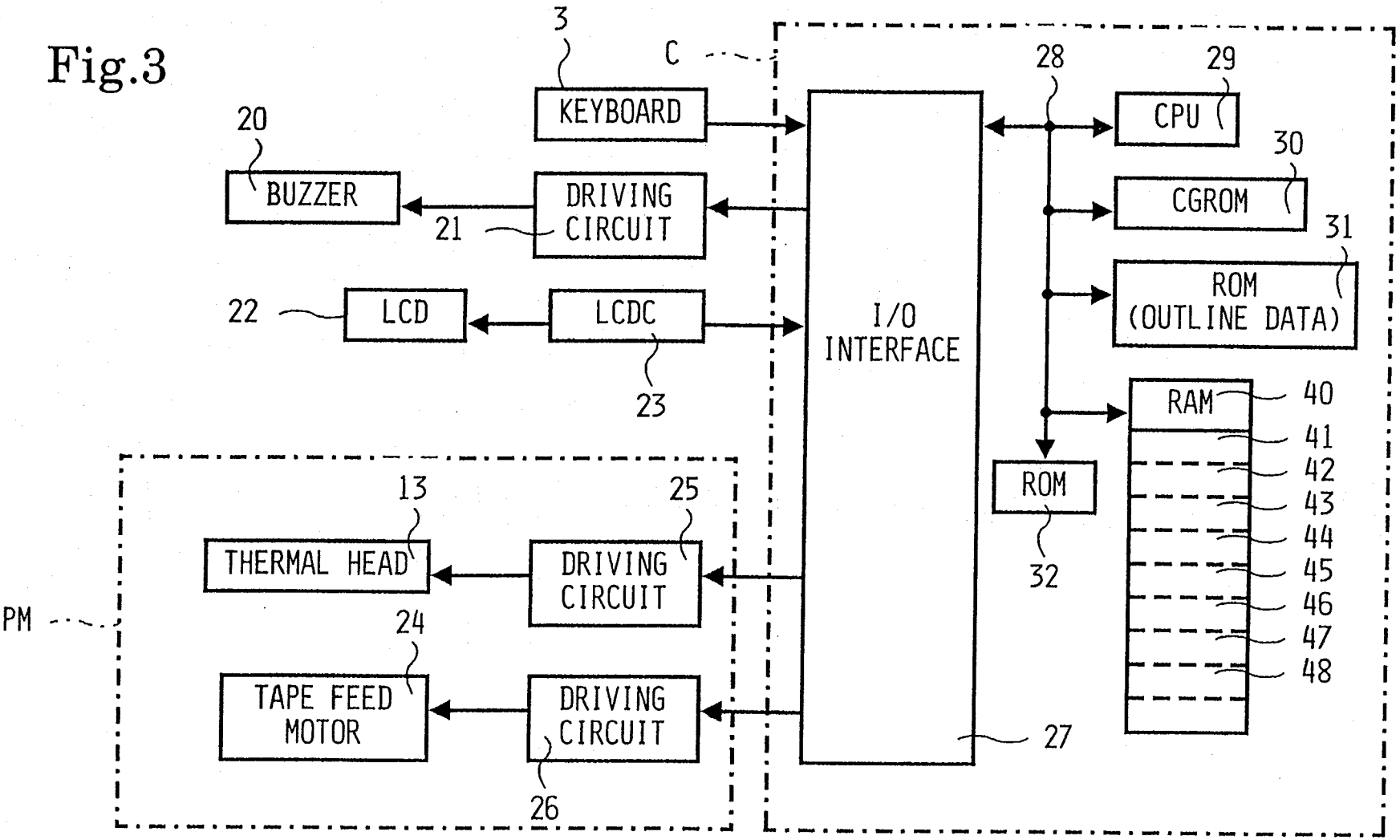
FIG. 3 is a block diagram of the control system for the tape printing apparatus.

The block diagram of FIG. 3 shows how the control system of the tape printing apparatus 1 is structured. The I/O interface 27 of a controller C is connected with a liquid-crystal display controller (LCDC) 23 that outputs display data to the LCD 22, a driving circuit 25 that drives the thermal head 13, a driving circuit 26 that drives the tape feed motor 24, and a driving circuit 21 that drives a warning buzzer 20. The controller C comprises a CPU 29, the I/O interface 27 connected to the CPU 29 via a bus arrangement 28 including a data bus, a CGROM 30, ROM's 31 and 32, and a RAM 40.

The CGROM (pattern data memory) 30 stores dot pattern data representing numerous characters and corresponding to the code data about the characters for display. The ROM (outline data memory) 31 stores outline data classified by font (Gothic, Mincho, etc.) and defining the outlines of numerous characters to be printed, the data corresponding to the code data about the characters.

The ROM 32 contains a display driving control program, an image development processing control program, a print driving control program and a tape print control program. The display driving control program controls the display controller 23 in accordance with the code data about the characters, numerals and symbols entered from the keyboard 3. The image development processing control program converts to dot pattern data the outline data corresponding to the code data in a text memory 41, and develops the dot pattern data in a print buffer 47 for printing. The print driving control program reads consecutively the data of the print buffer 47 and drives the thermal head 13 and tape feed motor 24 accordingly. The print driving control program is specific to this invention and will be described later in more detail. The image development processing control program includes various subroutines for controlling character modifications such as bold typeface and white-on-black character printing.

The RAM 40 includes the text memory 41, a print format memory 42, a scale length memory 43, a graduation line pitch memory 44, a numeral unit memory 45, a division counter 46, the print buffer 47 and a flag memory 48. The text memory 41 (corresponding to the input data storage means) stores as text data the code data representing the characters and symbols entered from the keyboard 3. The print format memory 42 contains data about a plurality of print formats. The data in the print format memory 42 include the data for defining the established character size, the data for defining the font, and modification data for the characters selected. The scale length memory 43 stores, in millimeters, the entire length SL of the scale designated. The graduation line pitch memory 44 accommodates the unit pitch (m, cm, mm) of the graduation lines of the scale selected, the pitch of small graduation lines SmL equivalent to unit divisions, the pitch of medium graduation lines ML provided at intervals of five unit divisions, and the pitch of large graduation lines LL provided at intervals of 10 unit divisions.

The numeral unit memory 45 stores numeral unit data "11" for a unit length of one meter (m), "10" for one centimeter (cm) and "01" for one millimeter (mm), the unit data representing the numeral unit, i.e., the length unit indicated by the division numeral selected. The division counter 46 contains a count value SC representing the number of all the divisions on the scale. The print buffer 47 accommodates the dot pattern data representing a plurality of characters and symbols developed as images for printing, as well as the dot pattern data for scale printing. To serve its purpose, the print buffer 47 has memory capacities of 128 bits (16 bites) corresponding to 128 dots in the vertical direction (dot column direction) and an appropriate number of bits corresponding to a plurality of characters in the horizontal direction (dot row direction). The flag memory 48 stores flag data representing a large division numeral flag LF set (to "1") when division numerals are printed to large graduation lines LL, flag data representing a medium division numeral flag MF set when division numerals are printed to medium graduation lines ML, and flag data representing a small division numeral flag SF set when division numerals are printed to small graduation lines SmL.

How the tape print control program is executed by the controller C of the tape printing apparatus 1 will now be described with reference to the flowchart of FIG. 4. In the figure, reference character Si (i=10, 11, 12, etc.) indicates steps to be carried out.

Figure 4:
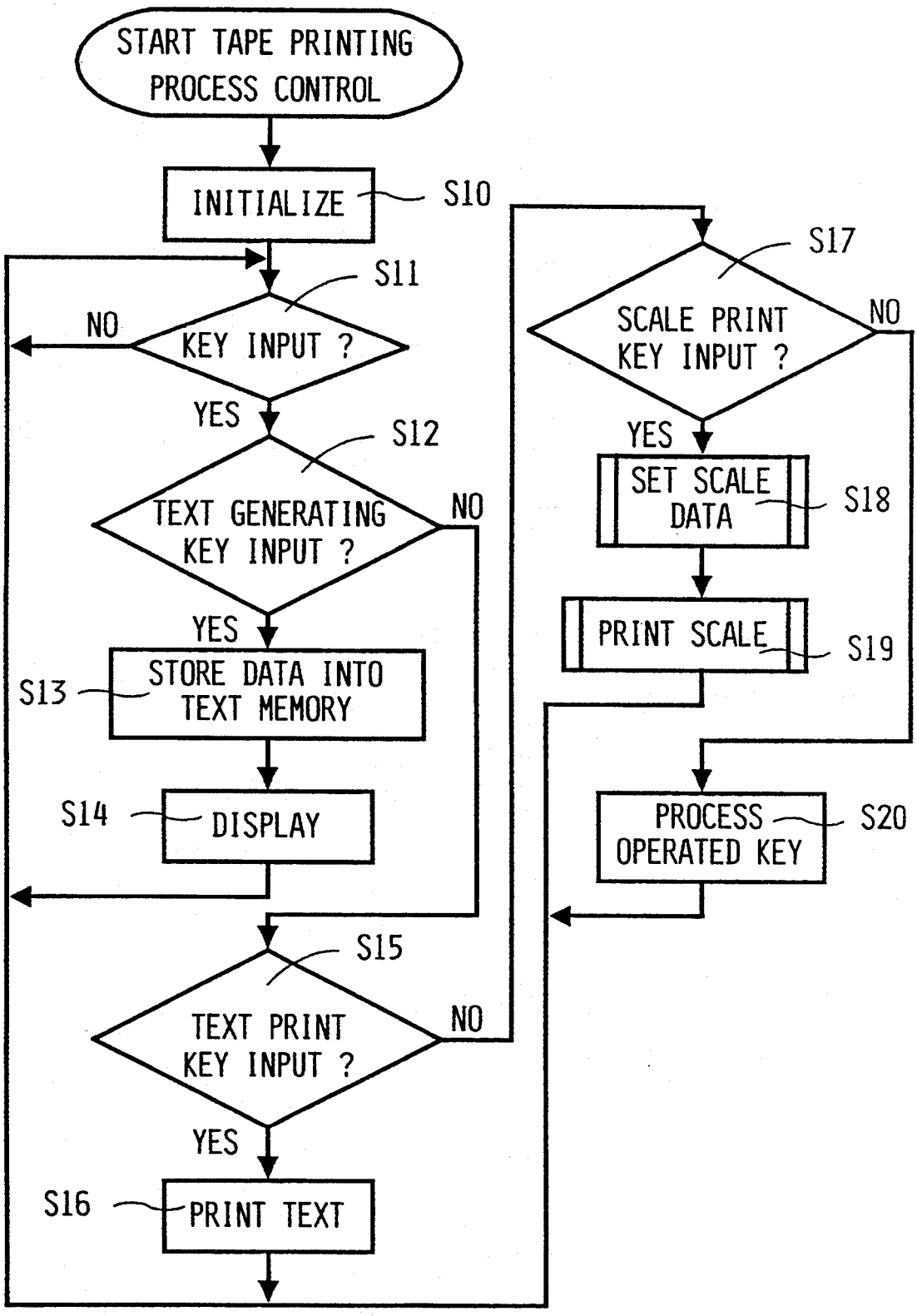
FIG. 4 is a flowchart of a tape printing control routine for use with the embodiment.

Operating the power key supplies power and starts the tape print control program whose steps are shown in FIG. 4. First, the memories 41 through 48 are cleared for initialization (step 10). If a key input is detected and if the key operated is a text-related key, such as a character key or a symbol key (YES in steps 11 and 12), the input character code is stored into the text memory 41 (step 13). The character or symbol represented by that character code is displayed on the LCD 22 (step 14) and step S11 is reached again.

If the text print key is operated (YES in step 11, NO in step 12, YES in step 15), a text printing process is carried out to print the text data stored in the text memory 41 (step 16) and step S11 is reached again. The text printing process is an ordinary printing process executed as follows: the dot pattern data corresponding to the character codes are read from the text memory 41 and are developed into the dot pattern data for printing according to the character size and font designated. The developed dot pattern data for printing are accommodated in the print buffer 47. The dot pattern data are then read from the print buffer 47 for output to the print mechanism PM that prints the data successively onto the printing tape 5.

If the scale print key is operated to print a scale (YES in step 11, NO in steps 12 and 15, YES in step 17), a scale data setting process (FIG. 5) is carried out wherein a plurality of setting data about the scale are input and established (step 18). A scale printing process (FIG. 6) is then carried out (step 19) before step 11 is reached again.

Figure 5:
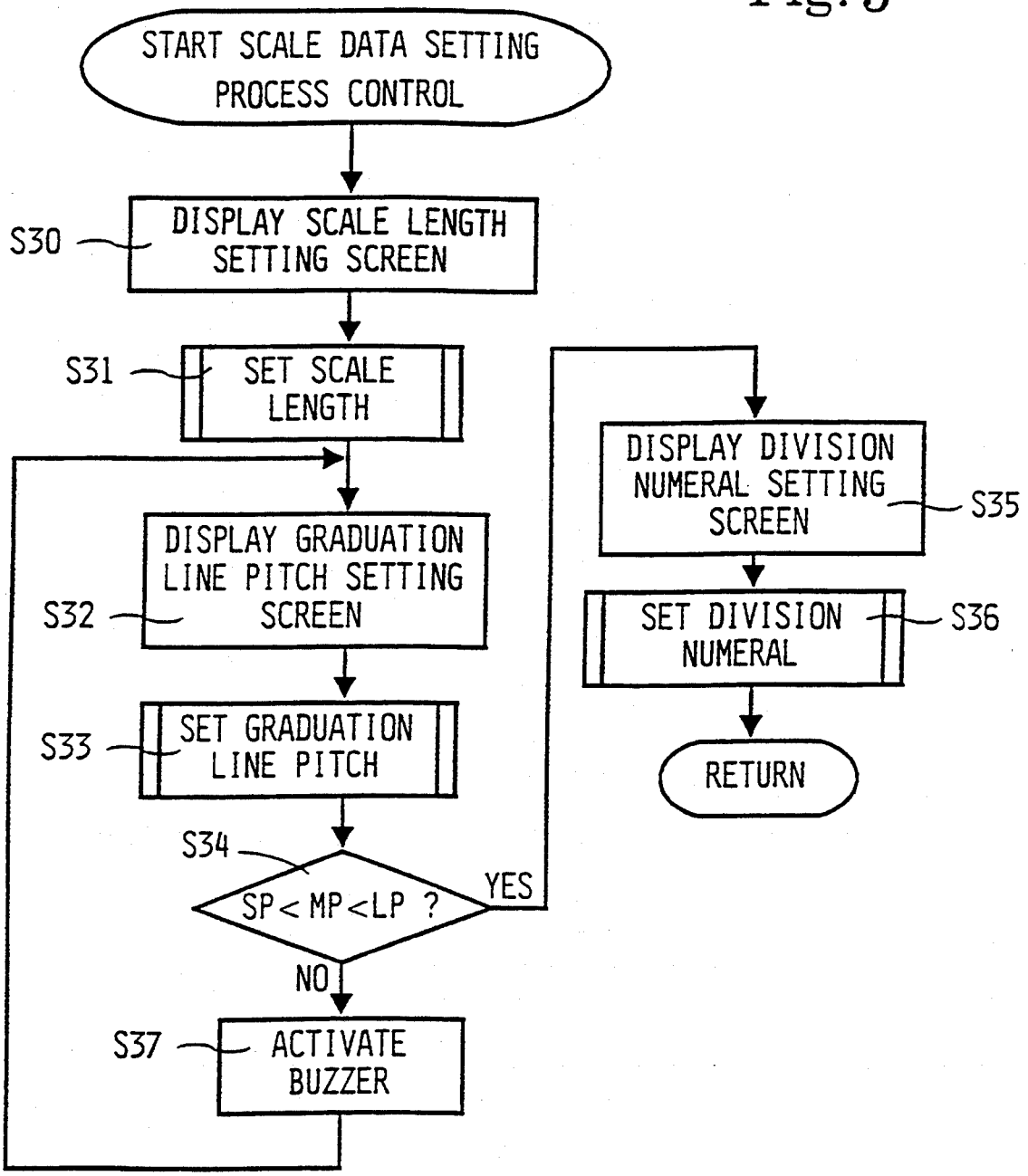
FIG. 5 is a flowchart of a scale data setting process control routine.

Described below, with reference to the flowchart of FIG. 5, is how the routine of the scale data setting process control is carried out. First, a scale length setting screen in which to set the total scale length is displayed on the LCD 22 (step 30). On the keyboard 3, numeric keys are operated to set the scale length in millimeters. Pressing the return key enters the scale length data SL into the scale length memory 43 (step 31). Typically, the scale length setting screen of FIG. 10 is displayed on the LCD 22. The user enters illustratively 200 mm into the underlined input field by pressing numeric keys "2", "0", and "0" in that order A graduation line pitch setting screen then appears on the LCD 22 (step 32). Numeric keys on the keyboard 3 are operated to set the unit pitch (m, cm, mm) for the graduation lines. Also set are the pitch of large graduation lines LL, the pitch of medium graduation lines ML and the pitch of small graduation lines SmL, all based on the unit pitch designated. Operating the return key enters into the graduation line pitch memory 44 the data representing the unit pitch as well as the pitches of the graduation lines LL, ML and SmL. The small graduation lines SmL generally stand for the divisions equivalent to unit pitches, the medium graduation lines ML for the divisions provided at intervals of five unit pitches, and the large graduation lines LL for the divisions provided at intervals of 10 unit pitches. Illustratively, the graduation line pitch setting screen of FIG. 11 appears on the LCD 22. For the item "PITCH (graduation line pitch)," the user designates one of the options "m", "cm", and "mm" by operating symbol keys. Also designated here are the item "LARGE" representing the pitch of large graduation lines LL, "MEDIUM" denoting the pitch of medium graduation lines ML, and "SMALL" indicating the pitch of small graduation lines SmL Illustratively, values "10", "5" and "1" (each the number of divisions) are set respectively for the large, medium and small pitches by use of numeric keys.

In generating a scale, the following condition needs to be met:

$$SP<MP<LP$$

where, LP stands for the large graduation line pitch, MP for the medium graduation line pitch, and SP for the small graduation line pitch. If the above condition is found to be met (YES in step 34), the LCD 22 displays a division numeral setting screen in which to designate or deny the need for printing division numerals in conjunction with the large, medium and/or small graduation lines LL, ML and/or SmL. Also designated on the division numeral setting screen is the length unit to be indicated by the division numerals (step 35).

Operating a cursor movement key (forward or backward) permits the selection and establishment of the unit length dimension (i.e., mm, cm, m, or inch) of the graduation lines to which the division numerals are to be printed. Pushing the return key sets the division numeral flag LF, MF or SF corresponding to the graduation lines in conjunction with which of the division numerals are designated, and stores the data about the designated numeral unit into the numeral unit memory 45 (step 36).

Step 36 is followed by step 19 of the tape printing control process wherein scale printing is executed. The division numeral setting screen such as that of FIG. 12 appears on the LCD 22. Of the three kinds of graduation lines LL, ML and SmL shown on this screen, the large graduation lines LL are illustratively designated by use of the division numeral unit (cm). This means that it is the large graduation lines to which the division numerals are printed in an accompanying manner. An entry "OFF" is made for each of the medium and small graduation lines ML and SmL to which division numerals are not printed. Thus, only the large division numeral flag LF is set, and the unit data "10" is stored into the numeral unit memory 45.

Figure 6:
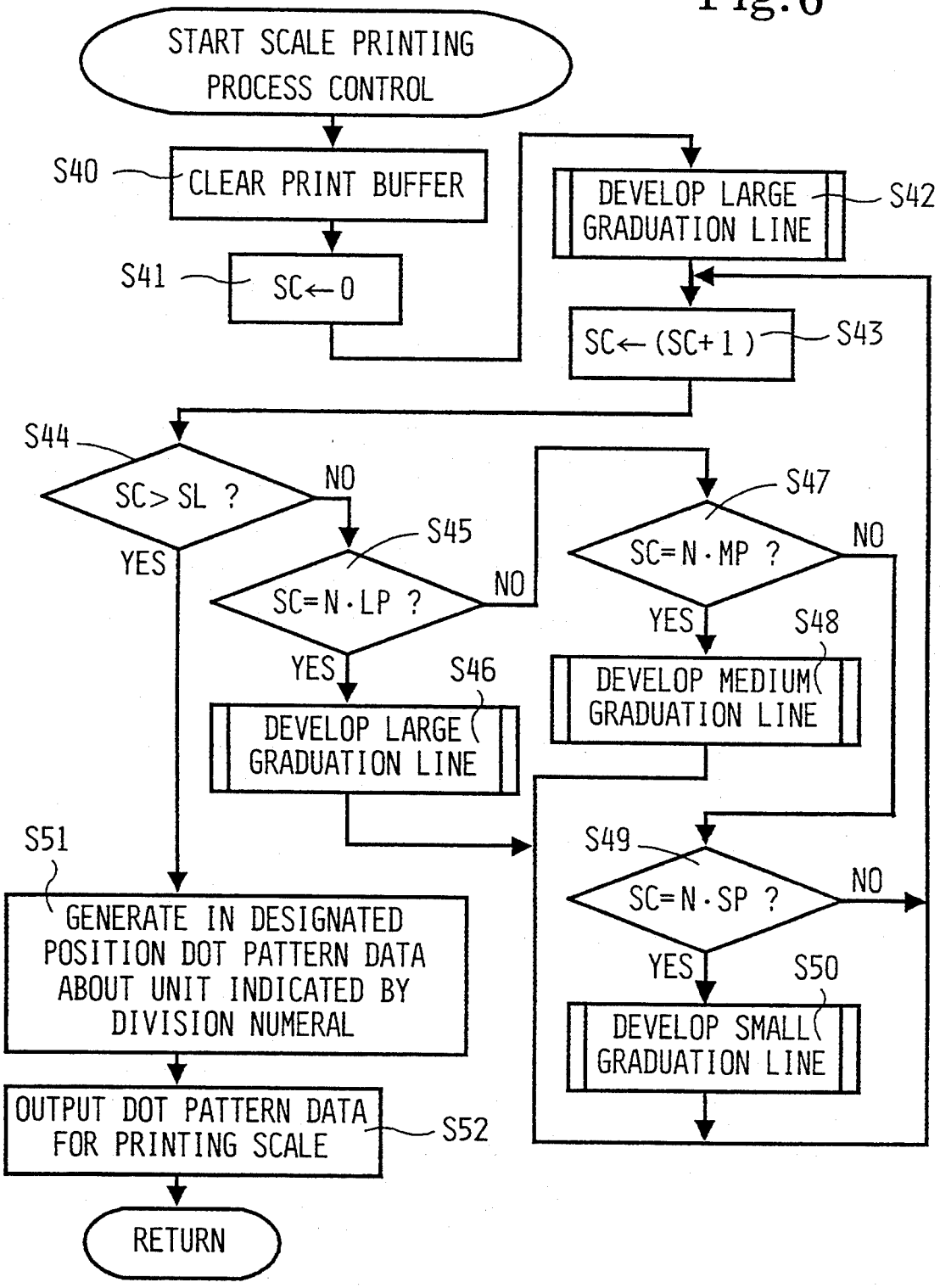
FIG. 6 is a flowchart of a scale printing process control routine.

The routine of scale printing process control will now be described with reference to the flowchart of FIG. 6. First, the print buffer 47 is cleared (step 40). An initial value "0" is set as the count value SC to the division counter 46 (step 41). Then the control process of developing large graduation lines (see FIG. 7) is carried out because the scale usually begins with a large graduation line LL (step 42). With the large graduation line development started, the developing position nD of the large graduation line LL corresponding to the count value SC in the print buffer 47 is obtained (step 60). Because one dot measures about 0.141 mm across, the developing position nD is obtained by dividing the count value SC by the dot size, i.e., $nD=SC/0.141$. The fractions of the quotient are rounded to the nearest whole number. The count value SC of 0 corresponds to the first position (i.e., leftmost position) in the print buffer 47.

Figure 13:
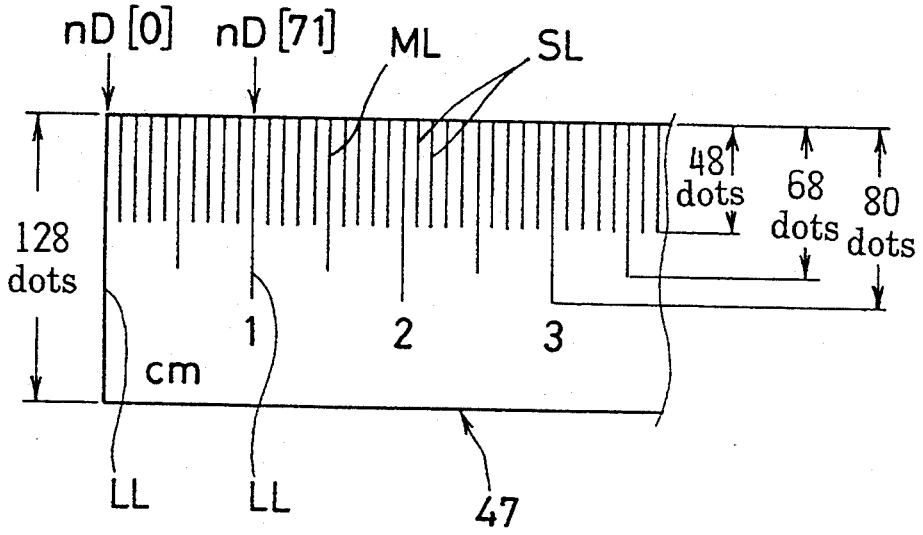
FIG. 13 is a view of typical dot pattern data set in the print buffer.

In this developing position nD, the dot pattern data representing the large graduation line LL that is two dot columns wide and about 80 dots long (step 61) is developed. For example, when the count value SC is 0 as shown in FIG. 13, the dot pattern data representing the large graduation line LL are developed in the nD [0] position, i.e., in the leftmost position of the print buffer 47.

If the large division numeral flag LF is found to be set (YES in step 62), and if the extension of the large graduation line LL has enough space to accommodate the developed dot pattern data on the division numeral of the designated character size (YES in step 63), the dot pattern data on the division numeral are developed as per the unit data stored in the numeral unit memory 45 so that the designated character size will be established (step 64). Step 64 is followed by step 43 for the scale printing process.

If the large division numeral flag LF is found not to be set (NO in step 62) or if the dot pattern data on the division numeral cannot be developed (NO in step 63), the large graduation line development process is terminated immediately. For example, when the count value SC is 0 and the position nD is 0 as shown in FIG. 13, there is no space in which to develop the dot pattern data for the division numeral. Where the count value SC is, say, 10 and the position nD is 71, there is enough space in which to develop the dot pattern data of a division numeral 1.

Next, the count value SC is incremented by 1 (step 43). If the count value is less than the scale length SL (NO in step 44), and if the count value SC is an integer multiple N of the large graduation line pitch LP (YES in step 45), the above-mentioned large graduation line development process is carried out (step 46). Step 46 is followed by step 43. If the count value SC is an integer multiple N of the medium graduation line pitch MP (NO in step 45, YES in step 47), the process of medium graduation line development control (see FIG. 8) is carried out (step 48). Step 48 is followed by step 43. The process of medium graduation line development control is approximately the same as that of large graduation line development control described above. Briefly, the developing position nD for the medium graduation line ML corresponding to the count value SC in the print buffer 47 is first obtained (step 70). In this developing position nD, the dot pattern data on the medium graduation line ML that is two dot columns wide and about 68 dots long (step 71) are developed.

If the medium division numeral flag MF is found to be set (YES in step 72), and if there is enough space in which to develop the dot pattern data of the numeral of the designated character size (YES in step 73), the dot pattern data on the division numeral is developed as per the unit data stored in the numeral unit memory 45 so that the designated character size will be established (step 74). Step 74 is followed by step 43 for the scale printing process. If the medium division numeral flag MF is found not to be set (NO in step 72) or if the printing of the division numeral is not possible (NO in step 73), the process of medium graduation line development control is terminated immediately.

If the count value SC is an integer multiple N of the small graduation line pitch SP (NO in steps 45 and 47, YES in step 49), the process of small graduation line development control (see FIG. 9) is carried out (step 50). Step 50 is followed by step 43. The process of small graduation line development control is approximately the same as that of large graduation line development control as described above. Briefly, the developing position nD for the small graduation line SmL corresponding to the count value SC in the print buffer 47 is first obtained (step 80). In this developing position nD, the dot pattern data on the small graduation line SmL that is two dot columns wide and about 48 dots long (step 81) are developed.

If the small division numeral flag SF is found to be set (YES in step 82), and if there is enough space in which to develop the dot pattern data of the numeral of the designated character size (YES in step 83), the dot pattern data on the division numeral is developed as per the unit data stored in the numeral unit memory 45 so that the designated character size will be established (step 84). Step 84 is followed by step S43 for the scale printing process. If the small division numeral flag SF is found not to be set (NO in step 82) or if the printing of the division numeral is not possible (NO in step 83), the process of small graduation line development control is terminated immediately.

Figure 14:
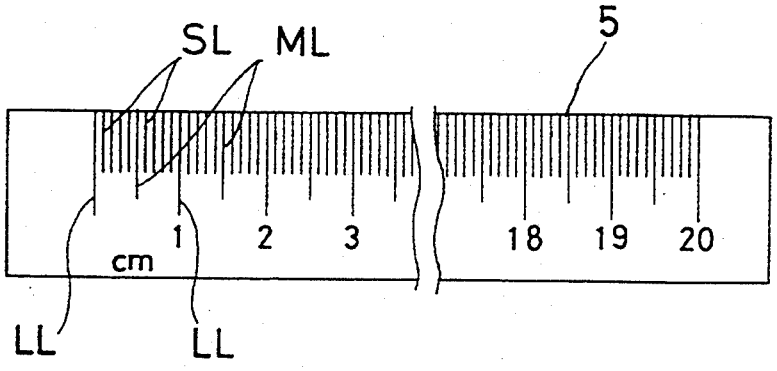
FIG. 14 is a plan view of a printing tape on which a scale has been printed.

If the count value SC is found to be greater than the scale length SL (YES in step 44), the dot pattern data on the unit indicated by the division numeral are developed in the designated position of the print buffer 47 (step 51). The dot pattern data for scale printing are then read consecutively from the print buffer 47 for output to the print mechanism PM, and the print mechanism PM prints the scale accordingly (step 52). Step 52 is followed by step 11 of the tape printing control process. For example, as shown in FIG. 13, the print buffer 47 contains the dot pattern data for scale printing made illustratively of a plurality of large, medium and small graduation lines LL, ML and SmL as well as division numerals 1, 2, 3, etc. It is according to these dot pattern data that the print mechanism PM prints the scale onto the printing tape 5, as depicted in FIG. 14.

Figure 15:
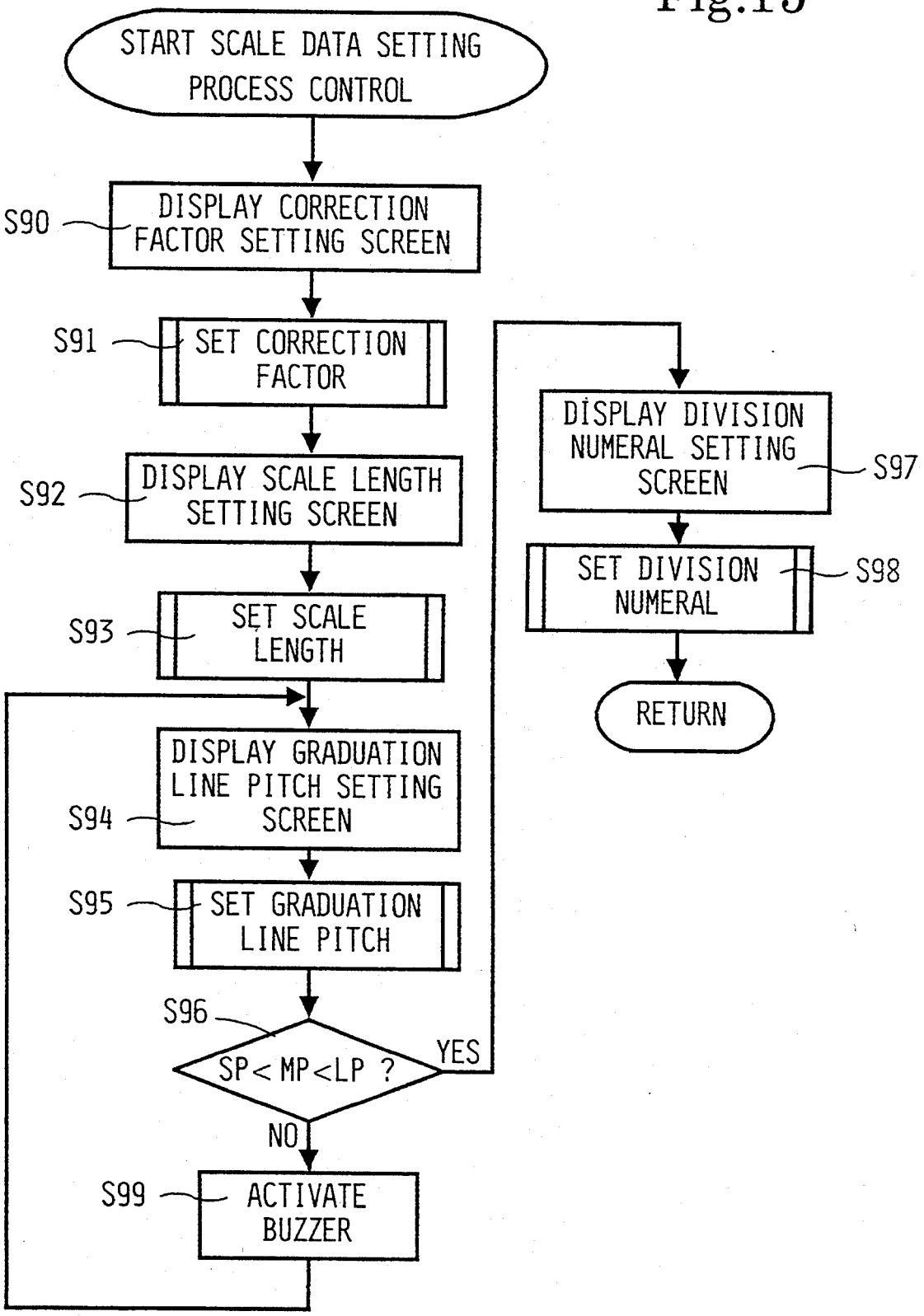
FIG. 15 is a flowchart of another scale data setting process control routine.

The above-described scale data setting process may be modified partially in which the pitch of the graduation lines LL, ML or SmL on the scale is corrected to compensate for the feed error of the printing tape 5, as outlined in FIG. 15. This modification aims at improving the precision of the scale printed. In the description that follows, the routines common to the above-described process will be omitted and only those different therefrom will be described.

When the scale data setting process is started, the LCD 22 first displays a correction factor setting screen which is used to correct the graduation line pitch in accordance with the feed error of the printing tape 5 (step 90). Numeric keys on the keyboard 3 are operated to designate the appropriate correction factor. Pushing the return key stores the correction factor data into a work memory of the RAM 40 (step 91). Thereafter, the scale length, the graduation line pitch and the division numerals are set in the manner described (steps 92 through 98). With the scale data setting process of FIG. 15 completed, the scale printing process of FIG. 6 starts to be executed. For example, the correction factor setting screen such as that of FIG. 16 is displayed on the LCD 22. In this screen, numeric keys are operated to enter, for example, 1.05 into the underlined input field.

When the scale printing process is carried out, the developing positions nD for the graduation lines LL, ML and SmL corresponding to the count value SC in the print buffer 47 are obtained as follows:

$$nD = SC/(0.141/\text{correction factor}).$$

Using this formula, the developing positions nD for the graduation lines LL, ML and SmL are acquired respectively in step 60 (of the large graduation line development process) following step 46, in step 70 (of the medium graduation line development process) following step 48, and in step 80 (of the small graduation line development process) following step 49. Thereafter, the dot pattern data on the graduation lines LL, ML and SmL are developed in the respective developing positions nD. As a result, the scale with its graduation line pitch set approximately at 1 mm is printed on the printing tape 5.

Figure 17:
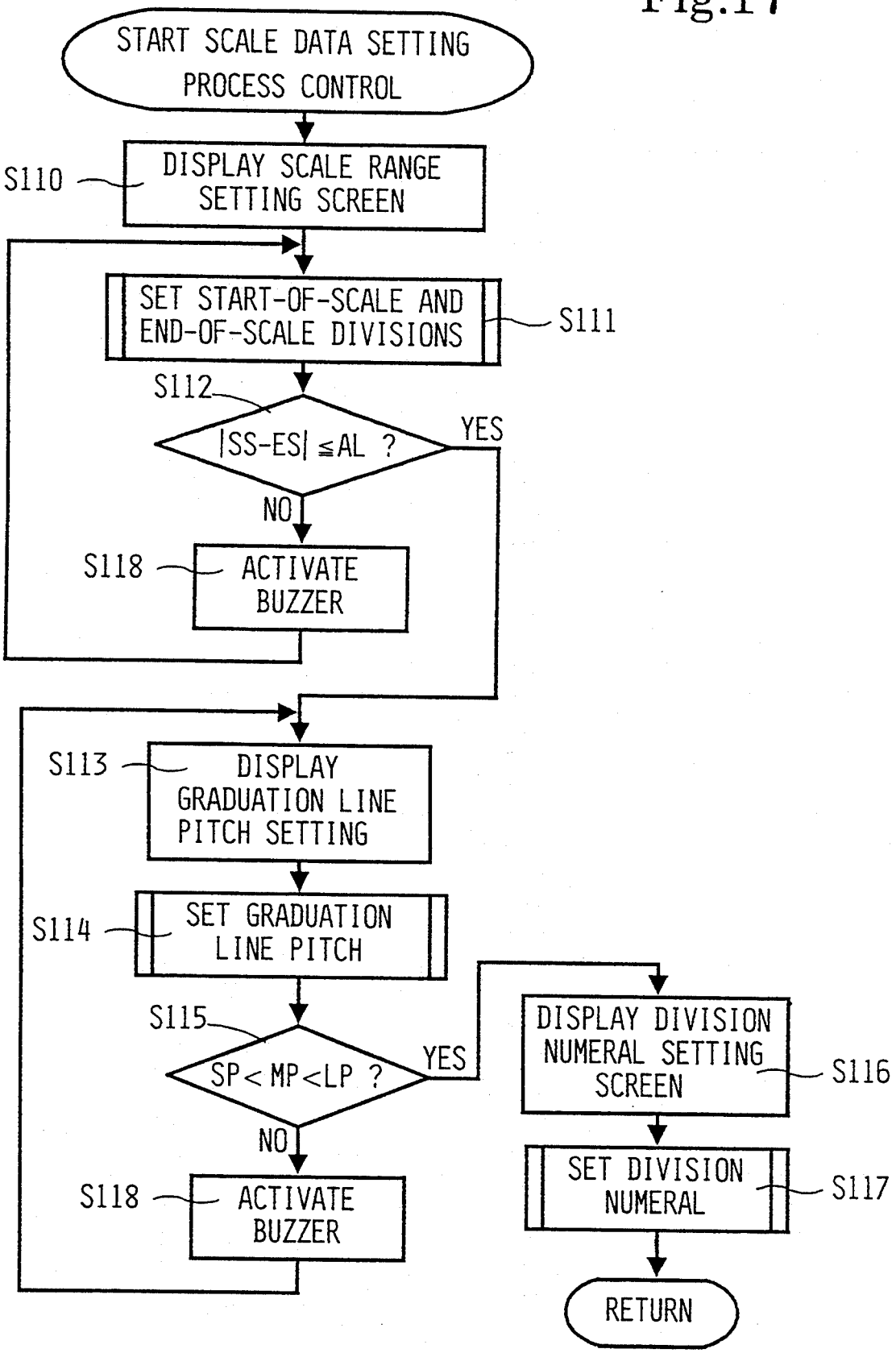
FIG. 17 is a flowchart of a further scale data setting process control routine.

Furthermore, the scale data setting process and the scale printing process may be modified partially as outlined in FIGS. 17 and 18. In these modifications, the starting and ending graduation lines of the scale may be set as desired. It is also possible to print the division numerals in descending order. In the description that follows, the routines common to the above-described scale data setting process will be omitted and only those different therefrom will be described.

When the scale data setting process is started, the LCD 22 first displays a scale range setting screen in which to designate the desired range of the scale to be printed (step 110). On the keyboard 3, numeric keys are operated to set a start-of-scale value SS and an end-of-scale value ES. Pushing the return key enters the two values SS and ES into the work memory of the RAM 40 (step 111).

If the absolute difference between the start-of-scale value SS and the end-of-scale value ES is equal to or less than the maximum scale length AL that may be created in the print buffer 47 (YES in step 112), the graduation line pitches and the division numerals are set consecutively (steps 113 through 117). With the scale data setting process concluded, the scale printing process of FIG. 18 is started. If the absolute difference between the start-of-scale value SS and the end-of-scale value ES is greater than the maximum scale length AL that may be created in the print buffer 47 (NO in step 112), the buzzer 20 is activated for warning (step 118), and step 111 is reached. For example, when the scale range setting screen is displayed on the LCD 22, numeric keys are operated to enter, say, 600 and 300 (mm) respectively into the start-of-scale and end-of-scale value fields underlined, as shown in FIG. 19.

In the scale printing process of FIG. 18, steps 125 and 126 are followed by the dot pattern data developing process for the first large graduation line LL (step 127). If the start-of-scale value SS is smaller than the end-of-scale value ES (YES in step 128), the count value SC is incremented by 1 (step 129). If the count value SC is smaller than the end-of-scale value ES (NO in step 130), step 131 is reached. If the start-of-scale value SS is greater than the end-of-scale value ES (NO in step 128), the count value SC is decremented by 1 (step 137). If the count value SC is greater than the end-of-scale value ES (NO in step 138), step 131 is reached.

Figure 7:
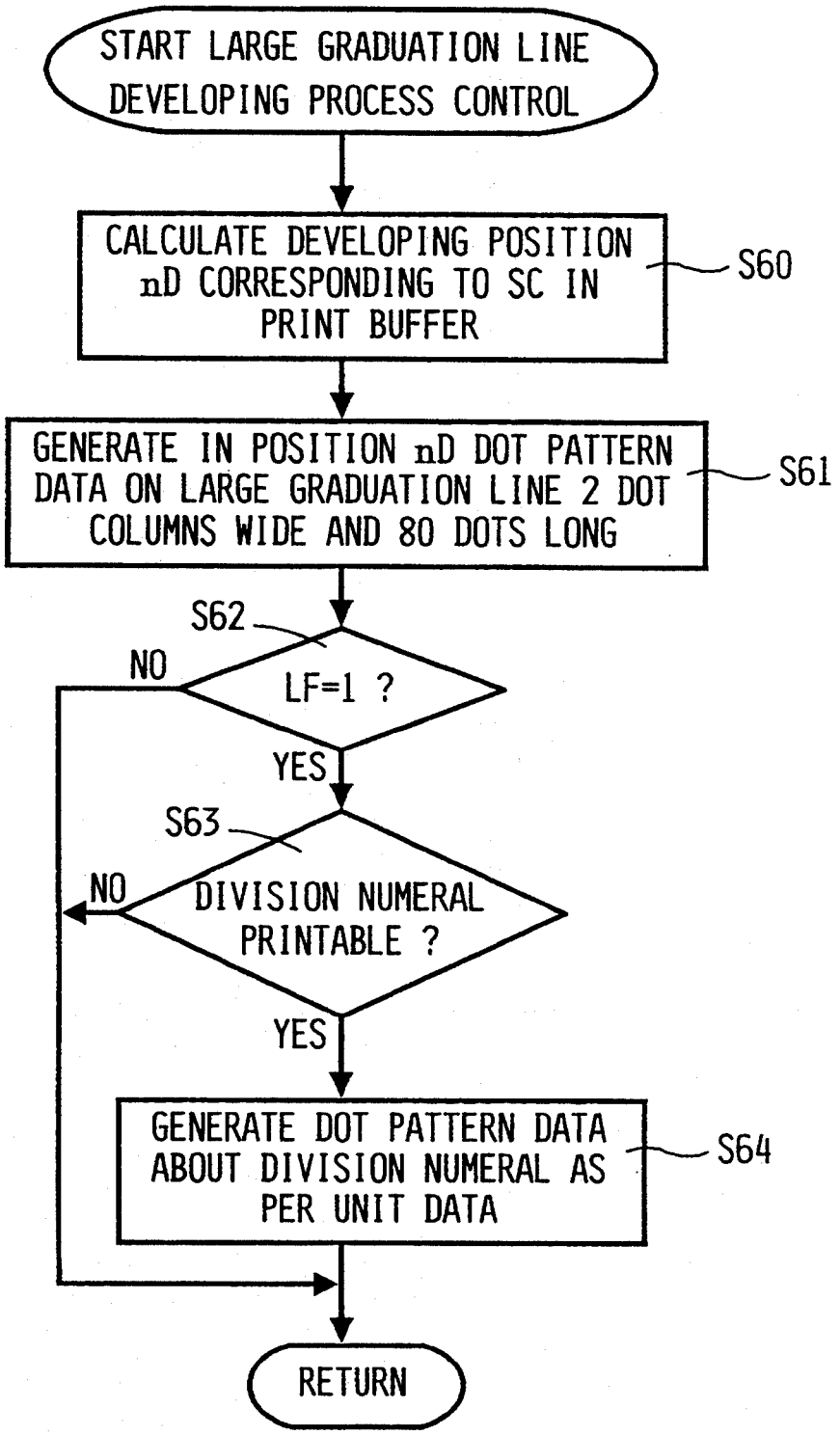
FIG. 7 is a flowchart of a large graduation line developing process control routine.
Figure 8:
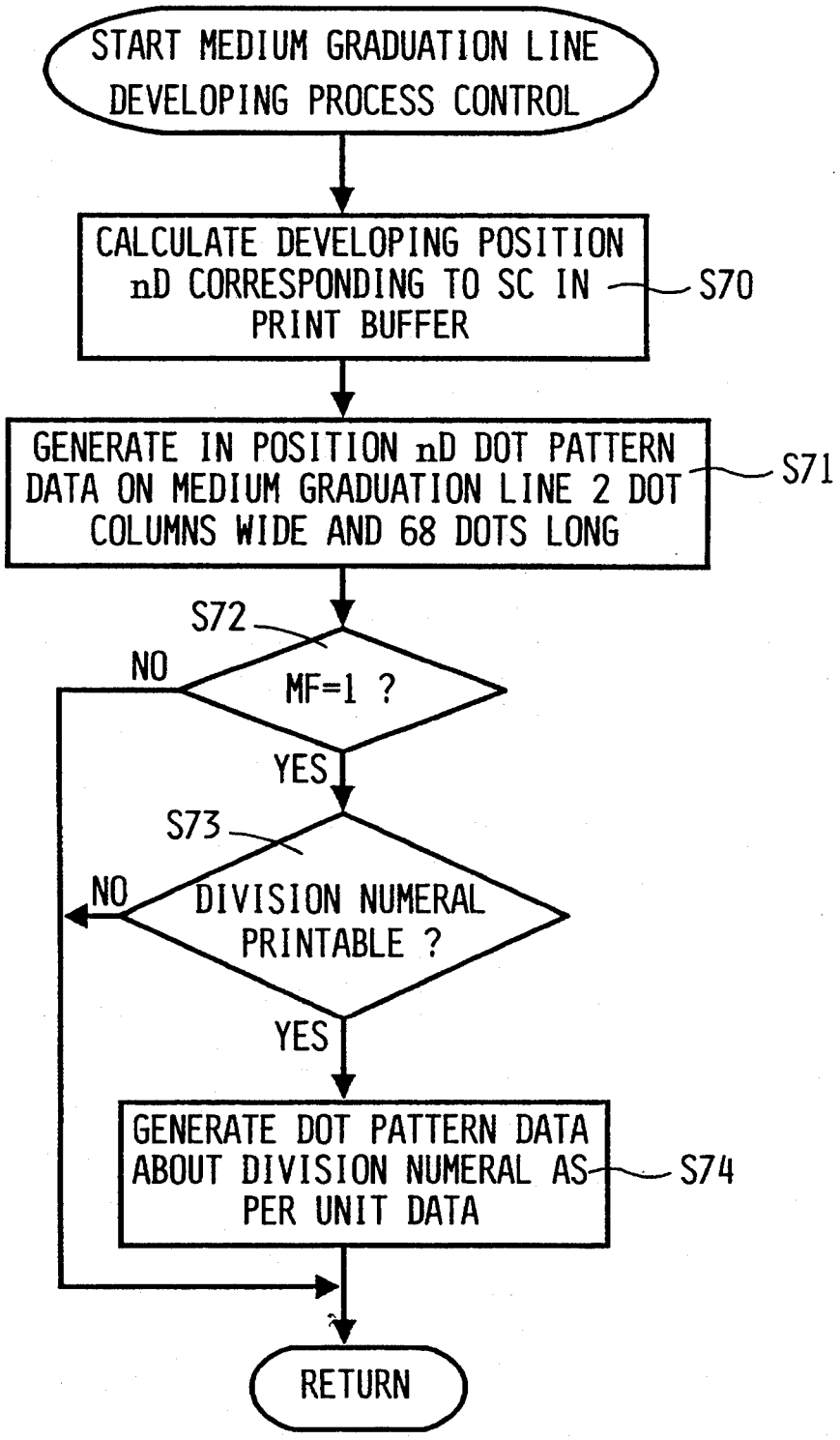
FIG. 8 is a flowchart of a medium graduation line developing process control routine.
Figure 9:
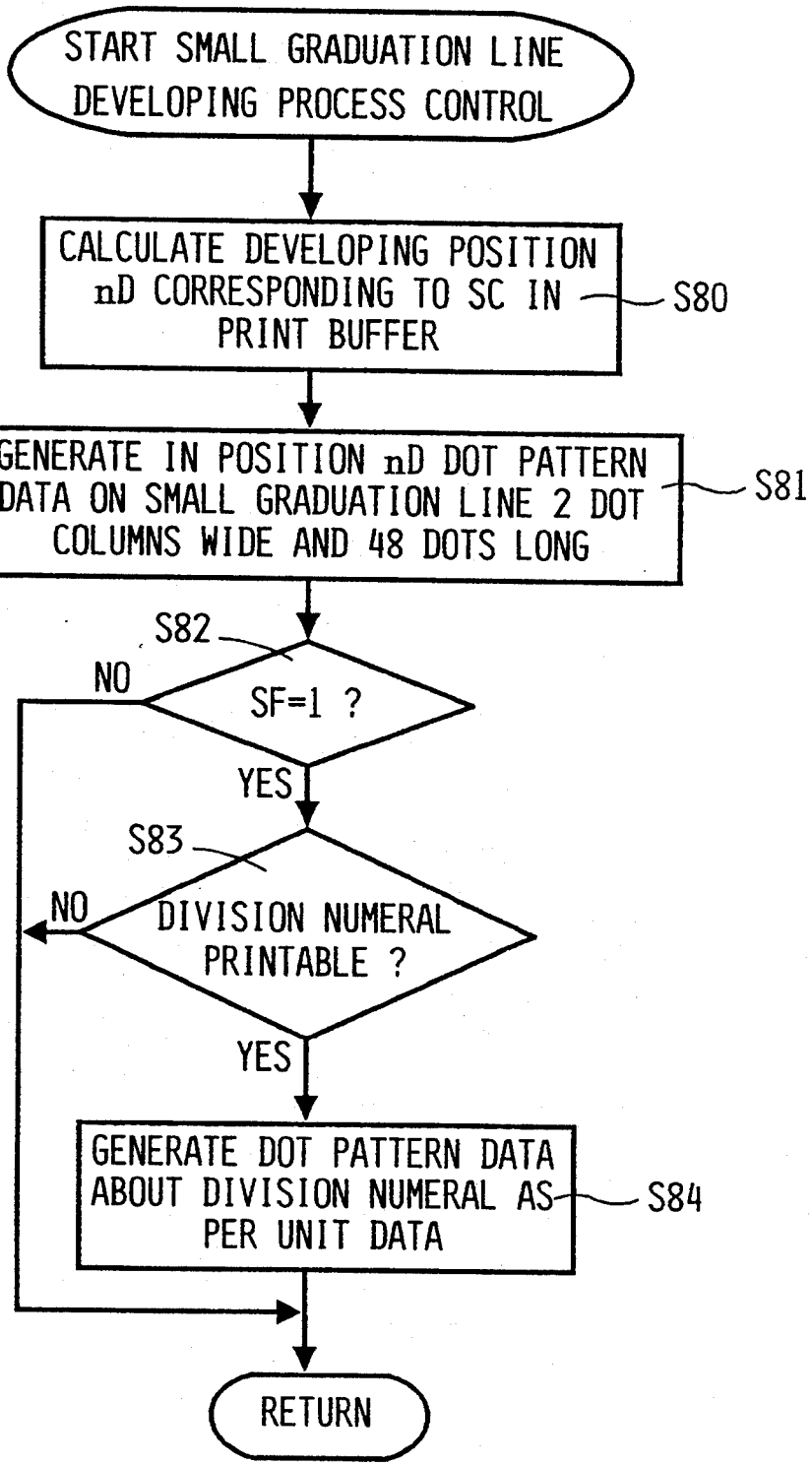
FIG. 9 is a flowchart of a small graduation line developing process control routine.
Figure 20:
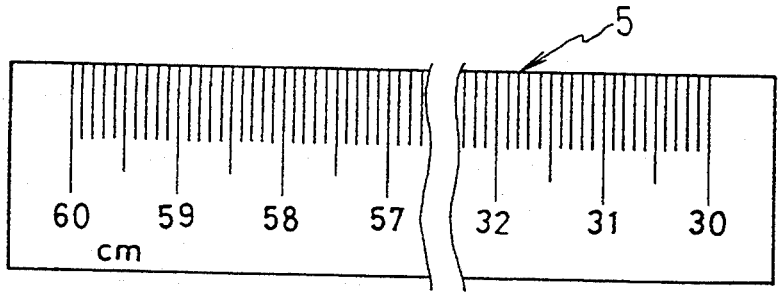
FIG. 20 is a view similar to FIG. 14 but showing a scale with its range designated.

As in steps 45 through 50 of the above-described scale printing process, the large graduation line developing process of FIG. 7, the medium graduation line developing process of FIG. 8 and the small graduation line developing process of FIG. 9 are executed successively (steps 131 through 136), and step 128 is reached. If the start-of-scale value SS is smaller than the end-of-scale value ES with the count value SC greater than the end-of-scale value ES (YES in step 130), and if the start-of-scale value SS is greater than the end-of-scale value ES with the count value SC smaller than the end-of-scale value ES (YES in step 138), the dot pattern data for the unit dimension, represented by the division numeral, are developed in step 139. In step 140, the dot pattern data for scale printing are read consecutively from the print buffer 47 for output to the print mechanism PM whereby the scale is printed. For example, as shown in FIG. 20, the scale having a starting division of 60 cm and an ending division of 30 cm is printed on the printing tape 5.

Figure 21:
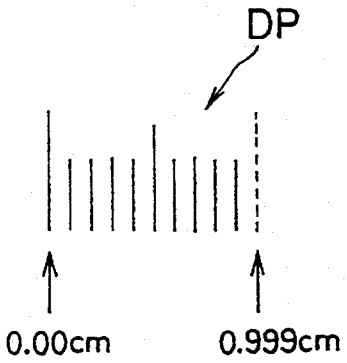
FIG. 21 is a view of typical dot pattern data representing a basic length of a scale printed alternatively according to the invention.

Suppose that the graduation line pitch is set for "mm," the small graduation line pitch SP for "1, " the medium graduation line pitch MP for "5" and the large graduation line pitch LP for "10." In this case, as illustrated in FIG. 21, the data about the dot pattern DP representing a basic repeatable length (e.g., 0.00 to 0.999 cm at which to print scale graduation lines LL, ML and SmL) may be stored beforehand in a nonvolatile memory such as the ROM 32. The stored data are matched with a plurality of combinations of the graduation line pitch, small graduation line pitch SP, medium graduation line pitch MP and large graduation line pitch LP. When the large graduation line pitch LP, small graduation line pitch SP, medium graduation line pitch MP and other conditions are set as desired, the data about the basic length dot pattern DP may be repeated as many times as needed to generate in the print buffer 47 the dot pattern data necessary for creating the desired scale.

The scale data setting process may be arranged to set the print positions of division numerals as well as the print positions of the length units indicated by the division numerals. The metric system adopted for printing by the embodiment above may be replaced with the inch system or any other measuring system. As variations of the invention, a plurality of setting items such as the scale length may be displayed in a menu format; the contents of the selected items may be displayed successively using cursor movement keys; or any other display-and-input techniques may be utilized for ease of operation.

Graduation line printing may be carried out by use of different line widths for the small, medium and large graduation lines. For example, printing the small graduation lines SmL thin, the large graduation lines LL thick and the medium graduation lines ML with an intermediate thickness enhances the appearance of the printed scale. It is possible to store beforehand the line thicknesses of the graduation lines in a ROM; each graduation line type may be set for a desired thickness value stored in advance. As another variation, it may be arranged that establishing the line thickness for one graduation line type will automatically set the line thicknesses of the remaining graduation line types.

A second preferred embodiment of the invention will now be described with reference to the accompanying drawings.

Figure 22:
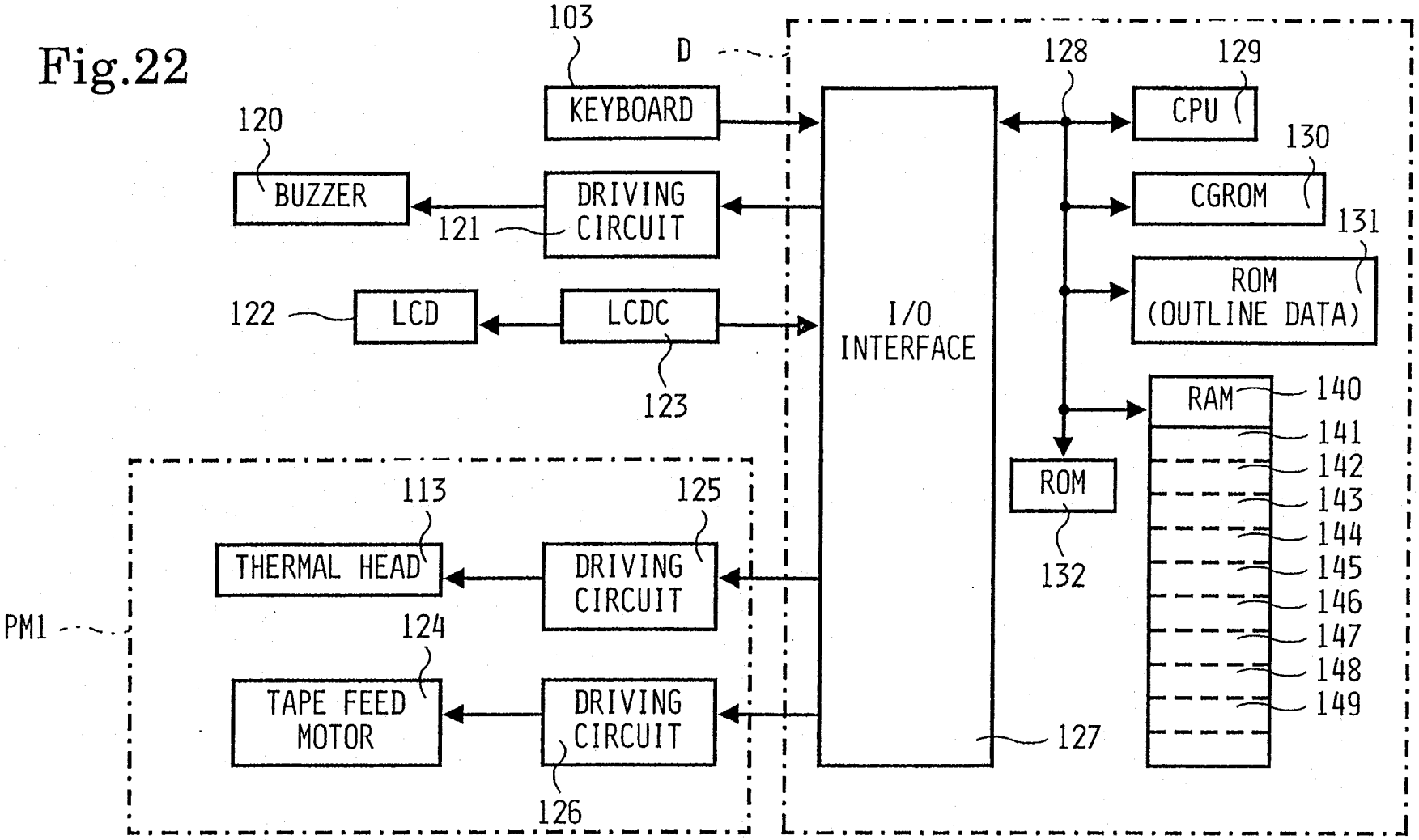
FIG. 22 is a block diagram of the control system for the tape printing apparatus of the second embodiment.

The block diagram of FIG. 22 shows how the control system of the tape printing apparatus of the second embodiment is structured. The I/O interface 127 of a controller D is connected with a liquid-crystal display controller (LCDC) 23 that outputs display data to the LCD 122, a driving circuit 125 that drives the thermal head 113, a driving circuit 126 that drives the tape feed motor 124, and a driving circuit 121 that drives a warning buzzer 120. The controller D comprises a CPU 129, the I/O interface 127 connected to the CPU 129 via a bus arrangement 128 including a data bus, a CGROM 130, ROM's 131 and 132, and a RAM 140.

The CGROM (pattern data memory) 130 stores dot pattern data representing numerous characters and corresponding to the code data about the characters for display. The ROM (outline data memory) 31 stores outline data classified by font (Gothic, Mincho, etc.) and defining the outlines of numerous characters to be printed, the data corresponding to the code data about the characters.

The ROM 132 contains a display driving control program, an image development processing control program, a print driving control program and a tape print control program. The display driving control program controls the display controller 123 in accordance with the code data about the characters, numerals and symbols entered from the keyboard 103. The image development processing control program converts to dot pattern data the outline data corresponding to the code data in a text memory 141, and develops the dot pattern data in a print buffer 148 for printing. The print driving control program reads consecutively the data of the print buffer 148 and drives the thermal head 113 and tape feed motor 124 accordingly. The print control program is specific to this invention and will be described later in more detail. The image development processing control program includes various subroutines for controlling character modifications such as bold typeface and white-on-black character printing.

The RAM 140 includes the text memory 141, a print format memory 142, a scaling factor memory 143, a scale length memory 144 and a graduation line pitch memory 145. The text memory 141 (corresponding to the input data storage means) stores as text data the code data representing the characters and symbols entered from the keyboard 103. The print format memory 142 contains data about a plurality of print formats. The data in the print format memory 142 include data for defining the character size established, data for defining the font, and modification data for the characters selected. The scaling factor memory 143 accommodates the scaling factor (for contraction or magnification) of the scale designated. The scale length memory 144 stores in millimeters the entire length SL of the scale designated. The graduation line pitch memory 145 stores the pitch of small graduation lines SmL equivalent to unit divisions, the pitch of medium graduation lines ML provided at intervals of five unit divisions, and the pitch of large graduation lines LL provided at intervals of 10 unit divisions.

The RAM 140 also includes a minimum pitch memory 146, a division counter 147, a print buffer 148 and a flag memory 149. The minimum pitch memory 146 accommodates data $\alpha$ about the minimum graduation line pitch calculated. The division counter 147 contains a count value SC representing the number of all the divisions on the scale. The print buffer 148 accommodates the dot pattern data representing a plurality of characters and symbols developed as images for printing, as well as the dot pattern data for scale printing. To serve its purpose, the print buffer 148 has memory capacities of 128 bits (16 bites) corresponding to 128 dots in the vertical direction (dot column direction) and an appropriate number of bits corresponding to a plurality of characters in the horizontal direction (dot row direction). The flag memory 149 stores flag data representing a large division numeral flag LF set (to "1") when division numerals are printed to large graduation lines LL, flag data representing a medium division numeral flag MF set when division numerals are printed to medium graduation lines ML, and flag data representing a small division numeral flag SF set when division numerals are printed to small graduation lines SmL.

How the tape print control program is executed by the controller D of the tape printing apparatus will now be described with reference to the flowchart of FIG. 23. In the figure, reference character Si (i=210, 211, 212, etc.) indicates steps to be carried out.

Figure 23:
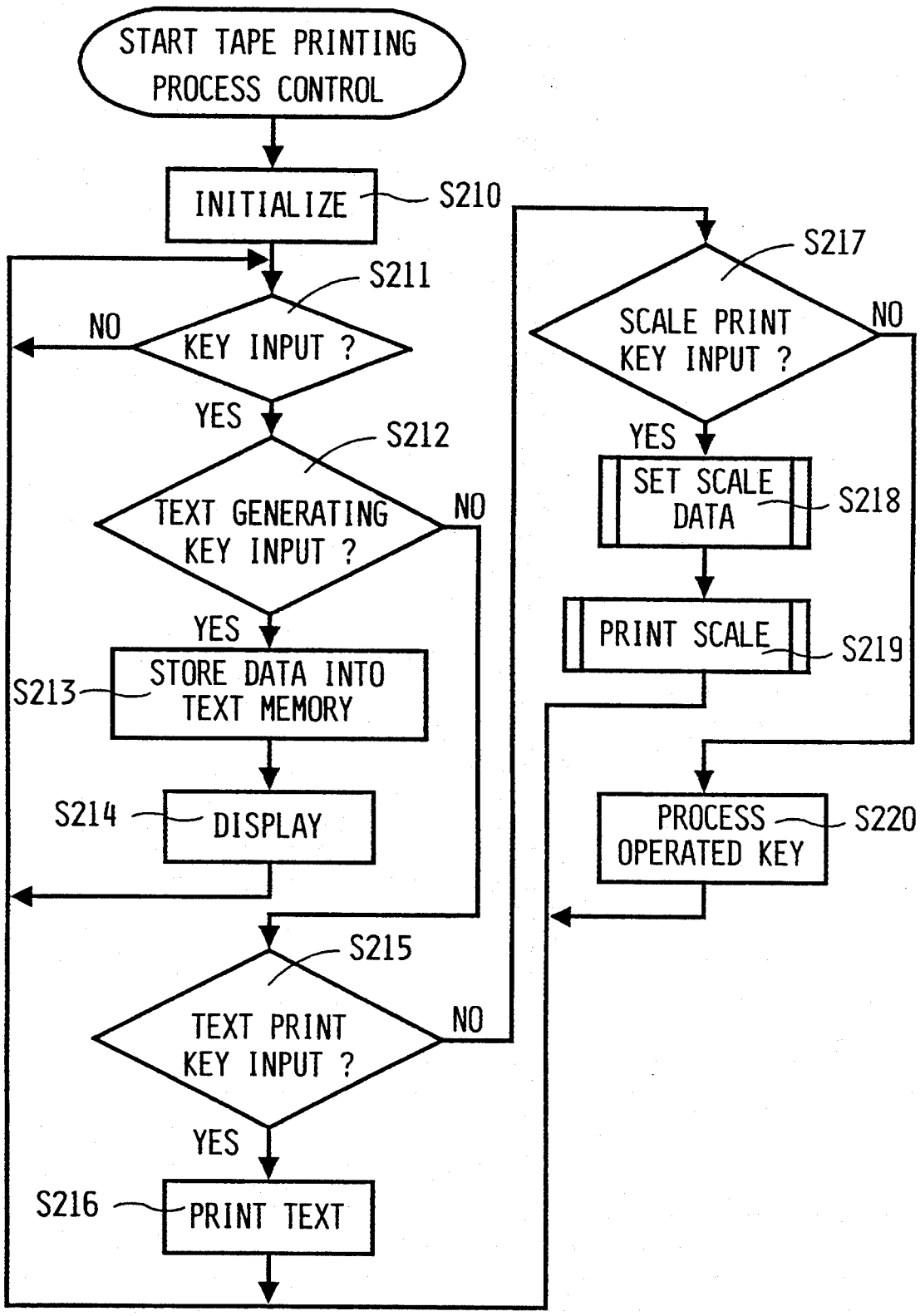
FIG. 23 is a flowchart of a tape printing control routine for use with the second embodiment.

Operating the power key supplies power and starts the tape print control program whose steps are shown in FIG. 23. First, the memories 141 through 149 are cleared for initialization (step 210). If a key input is detected and if the key operated is a text-related key such as a character key or a symbol key (YES in steps 211 and 212), the input character code is stored into the text memory 141 (step 213). The character or symbol represented by that character code is displayed on the LCD 122 (step 214) and step S211 is reached again.

If the text print key is operated (YES in step 211, NO in step 212, YES in step 215), a text printing process is carried out to print the text data stored in the text memory 141 (step 216) and step S211 is reached again. The text printing process is an ordinary printing process executed as follows: the dot pattern data corresponding to the character codes are read from the text memory 141 and are developed into the dot pattern data for printing according to the character size and font designated. The developed dot pattern data for printing are accommodated in the print buffer 148. The dot pattern data are then read from the print buffer 148 for output to the print mechanism PM1 that prints the data successively onto the printing tape 105.

If the scale print key is operated to print a scale (YES in step 211, NO in steps 212 and 215, YES in step 217), a scale data setting process (FIG. 24) is carried out wherein a plurality of setting data about the scale are input and established (step 218). A scale printing process (FIG. 25) is then carried out (step 219) before step 211 is reached again.

Figure 24:
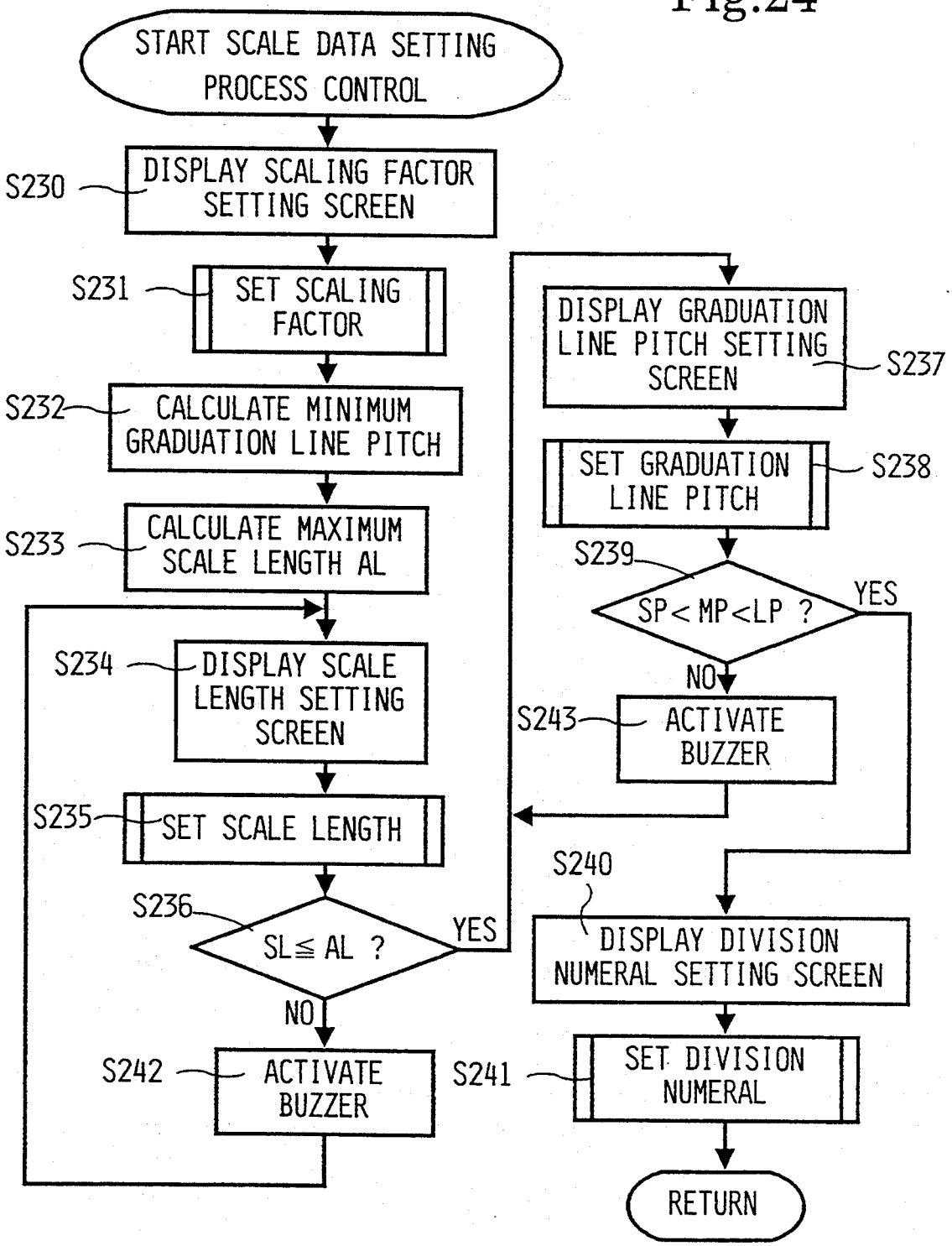
FIG. 24 is a flowchart of a scale data setting process control routine.

Described below with reference to the flowchart of FIG. 24 is how the routine of the scale data setting process control is carried out. First, a scaling factor setting screen (FIG. 29) in which to set a desired scaling factor is displayed on the LCD 122 (step 230). On the keyboard 103, numeric keys are operated to set the scaling factor for contraction or magnification. Then pressing the return key enters the scaling factor data into the scaling factor memory 143 (step 231). Typically, the scaling factor setting screen of FIG. 29 is displayed on the LCD 122. The user enters illustratively a scaling factor of 1/100,000 for contraction into the underlined input field by operating numeric keys.

Next, the minimum graduation line pitch $\alpha$ is calculated (step 232). The dot pitch, i.e., the dot diameter for printing by the print head is as small as 0.141 mm. This requires that for readability, each graduation line and the space between two adjacent graduation lines be expressed by at least three dot columns each. Here, it is possible to set the minimum graduation line pitch for six dot columns. If the length of six dot columns corresponds not to the unit length of the scale but to a fractional length thereof, it is necessary to set through calculations a minimum graduation line pitch of more than six dot columns and equal to the unit length of the scale. Graduation lines are determined according to that pitch. Where a scaling factor of, say, 1/100,000 is set, the minimum graduation line pitch $\alpha$ is set to be greater than $$\alpha > 0.141 \times 1/\text{scaling factor} \times 6 = 84.6 \text{ (m)}.$$

Illustratively, a unit scale length of 100 m (greater than 84.6 m) is selected as the minimum graduation line pitch $\alpha$.

Then a maximum scale length AL that may be generated in the print buffer 48 is obtained (step 233). The formula for calculating that length is:

$$AL = 0.141 \times (1/\text{scaling factor}) \times (\text{number of dot columns in the horizontal direction}).$$

When the LCD 122 displays a scale length setting screen (step 234), numeric keys are operated to set the desired scale length SL in scale length units. Pressing the return key sets the scale length data to the scale length memory 144 (step 235). For example, the scale length setting screen, such as that of FIG. 30, appears on the LCD 122. The user then sets, say, 30 km into the input field underlined using numeric keys.

If the scale length stored in the scale length memory 144 exceeds the maximum scale value AL (NO in step 236), the buzzer 220 is activated (step 242) as a warning.

Then, the scale length setting screen is again displayed (step 234). If the scale length SL is less than the maximum scale length AL (YES in step 236), the LCD 122 displays a graduation line pitch setting screen (step 237). On this screen, numeric keys are operated to set a pitch LP of large graduation lines LL, a pitch MP of medium graduation lines ML and a pitch SP of small graduation lines SmL, all based on the minimum graduation line pitch $\alpha$. Pushing the return key stores the data on the graduation line pitches LP, MP and SP into the graduation line pitch memory 145 (step 238).

The small graduation line pitch SP is usually equivalent to one minimum graduation line pitch $\alpha$, the medium graduation line pitch MP to five minimum graduation line pitches, and the large graduation line pitch LP to 10 minimum graduation line pitches. Illustratively, the graduation line pitch setting screen of FIG. 31 is displayed on the LCD 122. Referring to the minimum graduation line pitch $\alpha$ indicated (e.g., 100 m), the user operates numeric keys to set "10" to the item LARGE (pitch of large graduation lines LL), "5" to the item MEDIUM (pitch of medium graduation line ML) and "1" to the item SMALL (pitch of small graduation lines SML). Other settings than "10", "5", and "1" may also be made.

In generating a scale, the following condition needs to be met:

$$SP<MP<LP;$$

where SP stands for the large graduation line pitch, MP for the medium graduation line pitch, and SP for the small graduation line pitch. If the above condition is not met (NO in step 239), the buzzer 120 is activated (step 242) for warning and the graduation line pitch setting screen is again displayed (step 237). If the above condition is found to be met (YES in step 239), the LCD 122 displays a division numeral setting screen in which to designate or deny the need for printing division numerals in conjunction with the large, medium and/or small graduation lines LL, ML and/or SmL. Also designated on the division numeral setting screen is the length unit to be indicated by division numerals (step 240). Operating a cursor movement key (forward or backward) selects and establishes the graduation lines to which division numerals are to be printed in an accompanying manner, the lines being indicated on the display by an integer multiple of the minimum graduation line pitch $\alpha$. Pushing the return key sets a division numeral flag LF, MF or SF corresponding to the graduation lines LL, ML or SmL to which the division numerals are to be printed (step 241).

With the scale data setting process completed, step 219 of the tape print control program is reached in which the scale is printed. Illustratively, as shown in FIG. 32, the division numeral setting screen appears on the LCD 22. Of the three kinds of graduation lines LL, ML and SmL shown on the screen, the large graduation lines LL are illustratively designated by use of an integer multiple "×10" of the minimum graduation line pitch $\alpha$. This means that it is the large graduation lines to which the division numerals are printed in an accompanying manner. An entry "OFF" is made for each of the medium and small graduation lines ML and SmL to which division numerals are not printed. Thus, only the large division numeral flag LF is set.

Figure 25:
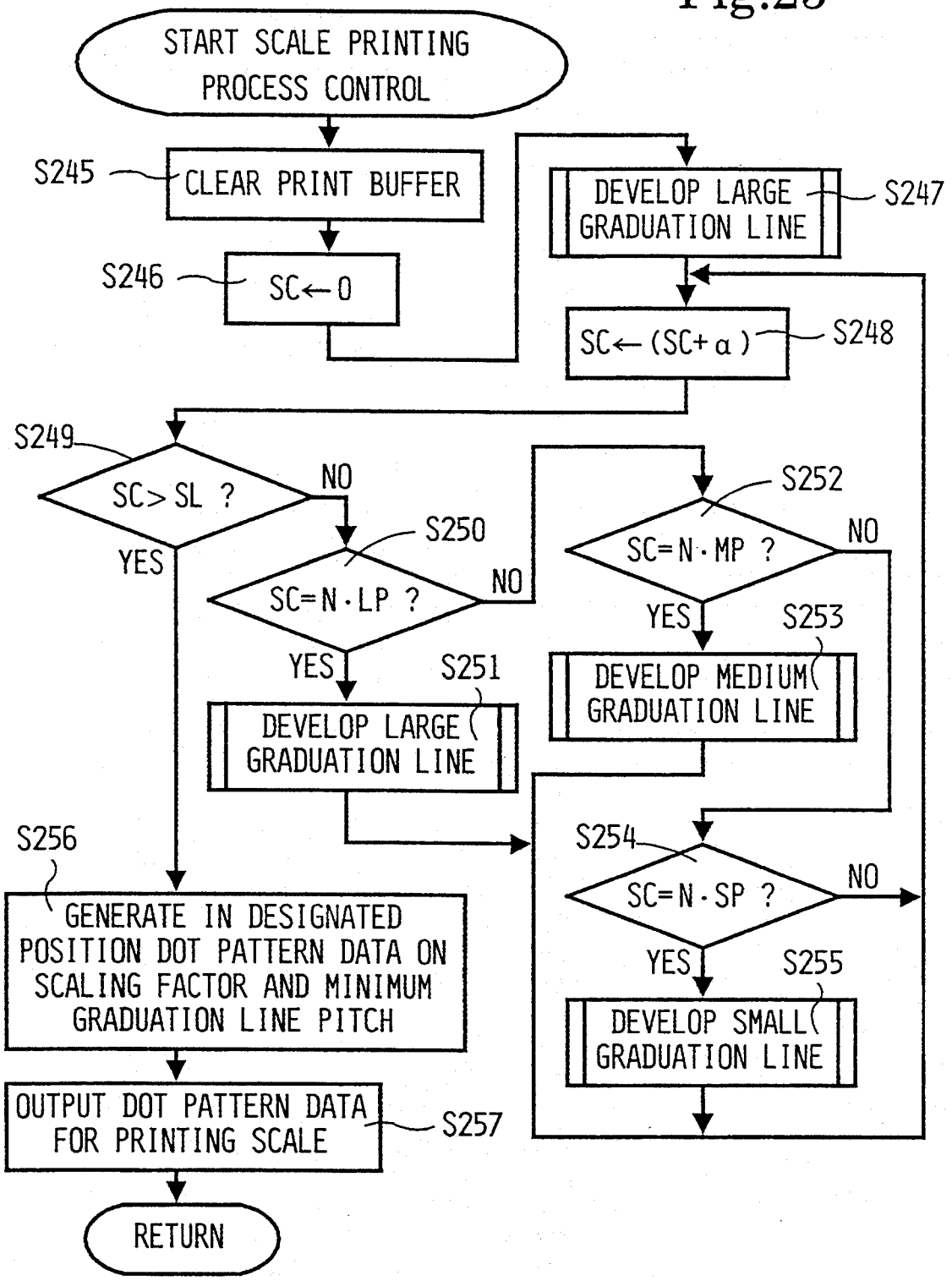
FIG. 25 is a flowchart of a scale printing process control routine.
Figure 26:
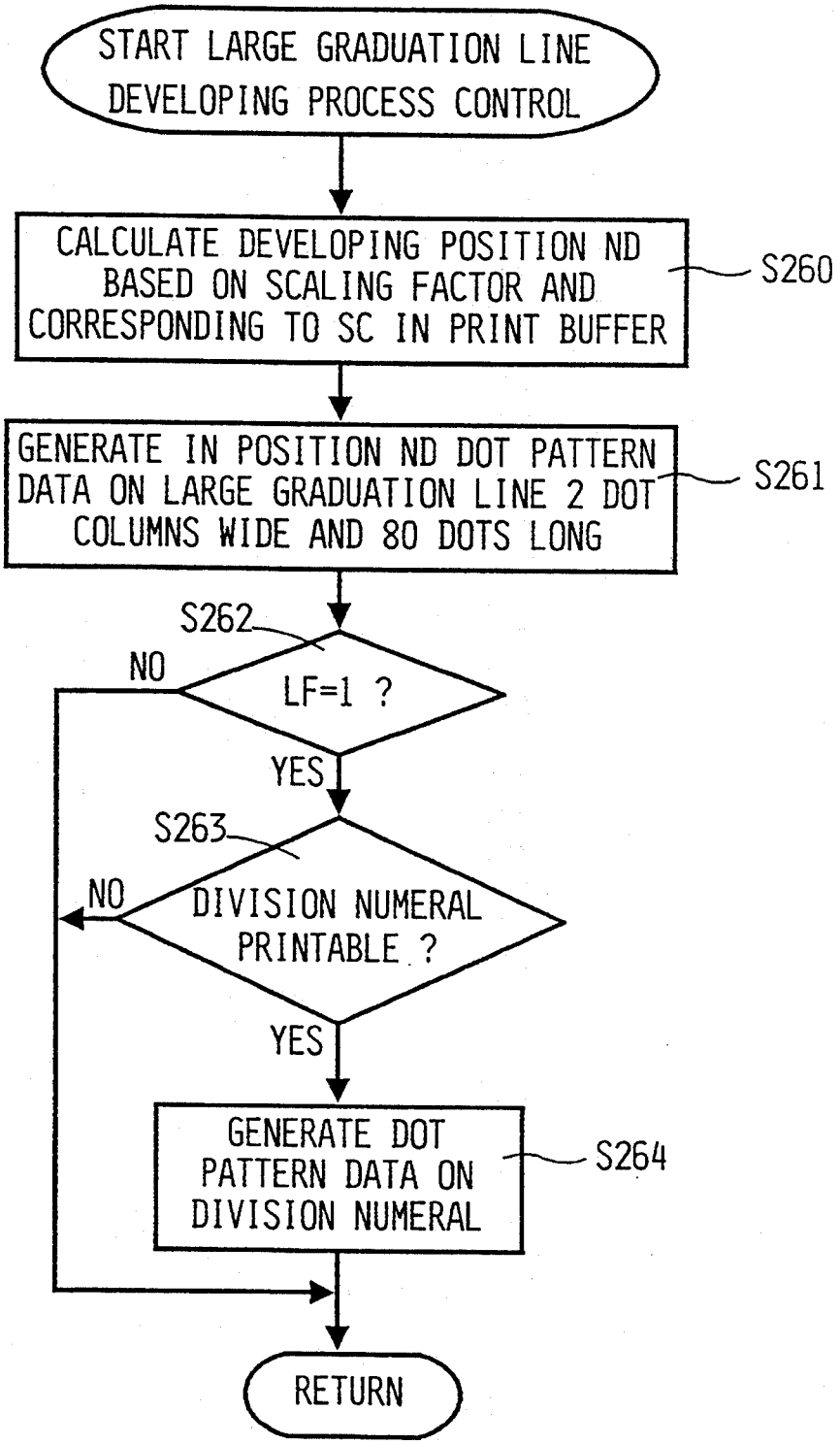
FIG. 26 is a flowchart of a large graduation line developing process control routine.

The routine of scale printing process control will be described with reference to the flowchart of FIG. 25. First, the print buffer 148 is cleared (step 245). An initial value "0" is set as the count value SC to the division counter 147 (step 246). Then the control process of developing large graduation lines (see FIG. 26) is carried out because the scale usually begins with a large 10 graduation line LL (step 247).

With the large graduation line development started, the developing position nD of the large graduation line LL corresponding to the count value SC in the print buffer 148 is obtained (step 260). The formula for obtaining the developing position is:

$$nD=(\text{count value } SC\times\text{scaling factor})/0.141.$$

The fractions of the quotient are rounded to the nearest whole number. The count value SC of 0 corresponds to the first position (i.e., leftmost position) in the print buffer 148.

Figure 34:
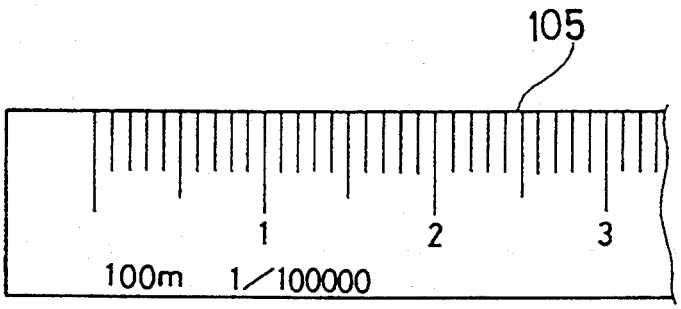
FIG. 34 is a plan view of a printing tape on which a scale has been printed with a scaling factor for contraction.

In this developing position nD, the dot pattern data representing the large graduation line LL that is two dot columns wide and about 80 dots long (step 261) are developed. For example, when the count value SC is 0, as shown in FIG. 34, the dot pattern data representing the large graduation line LL is developed in the nD [0] position, i.e., in the leftmost position of the print buffer 148.

If the large division numeral flag LF is found to be set (YES in step 262), and if the extension of the large graduation line LL has enough space to accommodate the developed dot pattern data on the division numeral of the designated character size (YES in step 263), the dot pattern data on the division numeral are developed so as to attain the designated character size (step 264). The developing of the dot pattern data is carried out according to the integer multiple and count value SC designated for the large graduation lines LL. The value obtained by dividing the count value SC by the multiple of graduations for spacing between the graduation lines (SmL, ML, LL) is the numeral used to identify the particular graduation line. Step 264 is followed by step 248 for the scale printing process.

Figure 33:
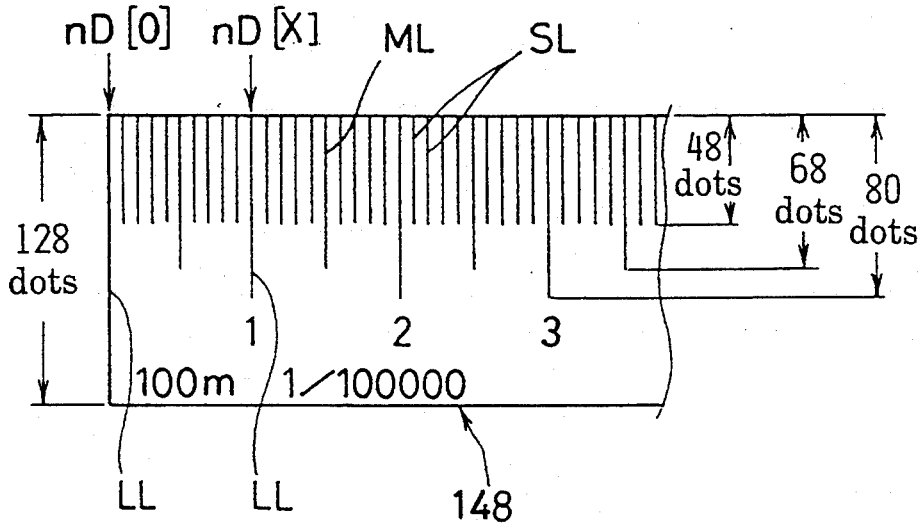
FIG. 33 is a view of typical dot pattern data set in the print buffer.

If the large division numeral flag LF is found not to be set (NO in step 262), and if the dot pattern data on the division numeral cannot be developed (NO in step 263), the large graduation line developing process is terminated immediately. For example, when the count value SC is 0 and the position nD is 0, as shown in FIG. 33, there is no space in which to develop the dot pattern data for the division numeral. Where the count value SC is, say, 10 and a second large graduation line LL is in effect (i.e., X is set for position nD), there is enough space in which to develop the dot pattern data on a division numeral 1.

Figure 27:
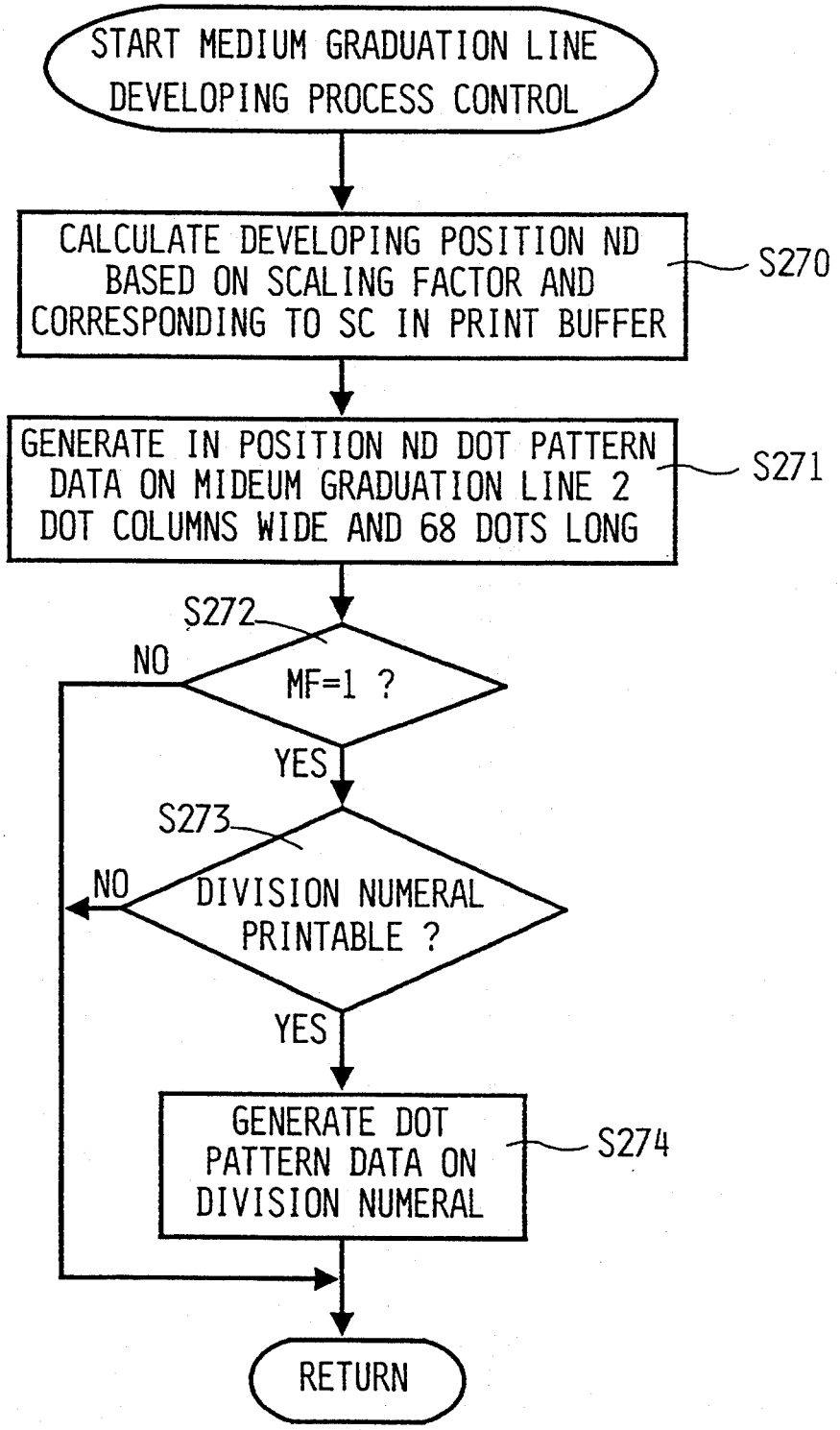
FIG. 27 is a flowchart of a medium graduation line developing process control routine.

Next, the count value SC is incremented by one minimum graduation line pitch $\alpha$ (step 248). If the count value is less than the scale length SL (NO in step 249), and if the count value SC is an integer multiple N of the large graduation line pitch LP (YES in step 250), the above-mentioned large graduation line developing process is carried out (step 251). Step 251 is followed by step 248. If the count value SC is an integer multiple N of the medium graduation line pitch MP (NO in step 250, YES in step 252), the process of medium graduation line development control (see FIG. 27) is carried out (step 253). Step 253 is followed by step 248. The process of medium graduation line development control is approximately the same as that of large graduation line development control described above. Briefly, the developing position nD for the medium graduation line ML is first obtained on the basis of the scaling factor data (step 270). In this developing position nD, the dot pattern data on the medium graduation line ML that is two dot columns wide and about 68 dots long (step 271) are developed.

If the medium division numeral flag MF is found to be set (YES in step 272), and if there is enough space in which to develop the dot pattern data for the numeral of the designated character size (YES in step 273), the dot pattern data on the division numeral are developed so as to attain the designated character size (step 274). Step 274 is followed by step S248 for the scale printing process. If the medium division numeral flag MF is found not to be set (NO in step 272), and if the printing of the division numeral is not possible (NO in step 273), the process of medium graduation line development control is terminated immediately.

Figure 28:
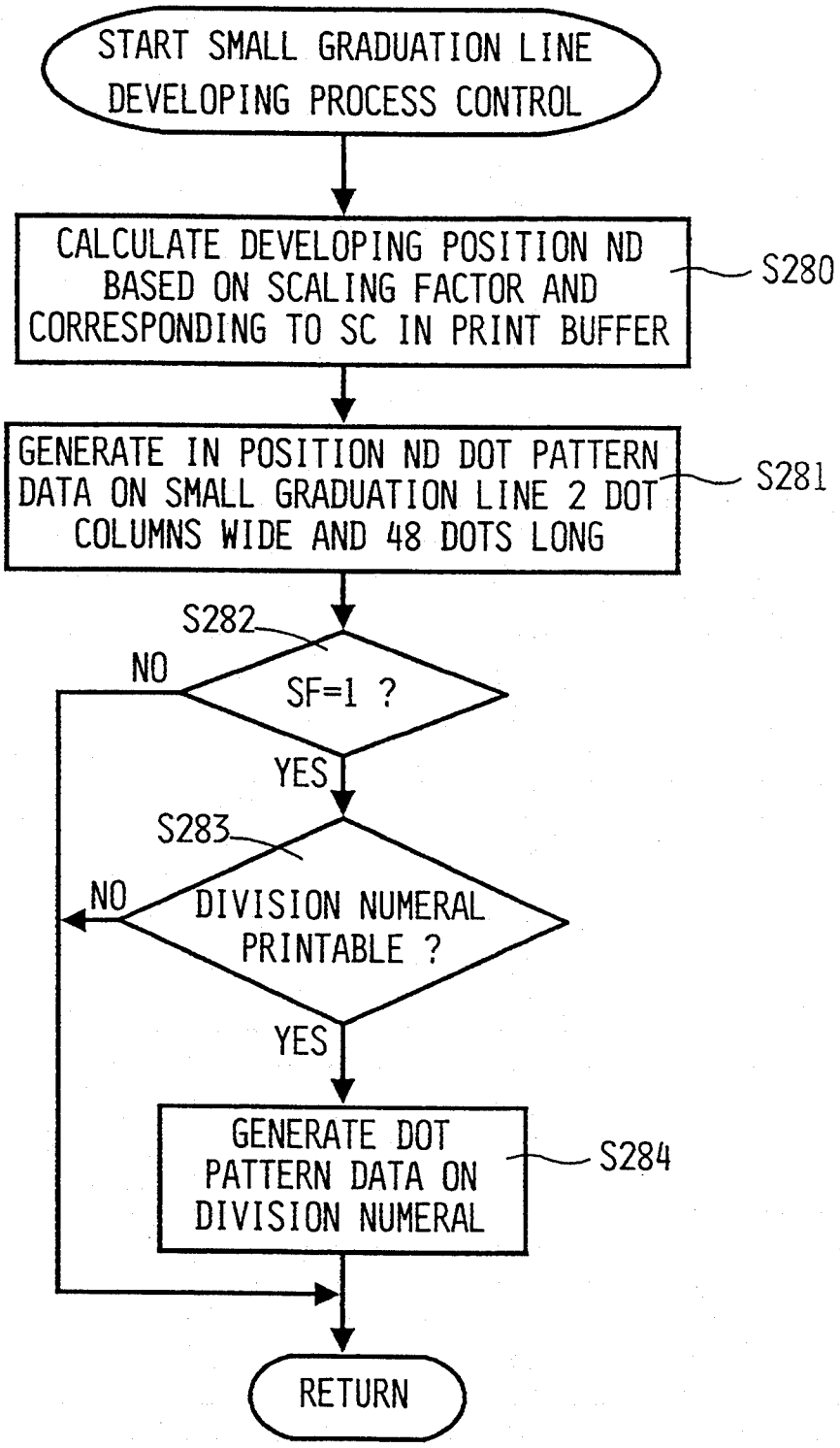
FIG. 28 is a flowchart of a small graduation line developing process control routine.

If the count value SC is an integer multiple N of the small graduation line pitch SP (NO in steps 250 and 252, YES in step 254), the process of small graduation line development control (see FIG. 28) is carried out (step 255). Step 255 is followed by step 248. The process of small graduation line development control is approximately the same as that of large graduation line development control described above. Briefly, the developing position nD for the small graduation line SmL is first obtained on the basis of the scaling factor data (step 280). In this developing position nD, the dot pattern data on the small graduation line SL that is two dot columns wide and about 48 dots long (step 281) are developed.

If the small division numeral flag SF is found to be set (YES in step 282), and if there is enough space in which to develop the dot pattern data on the numeral of the designated character size, the numeral being equivalent to the count value SC (YES in step 283), the dot pattern data on the division numeral are developed so as to attain the designated character size (step 284). Step 284 is followed by step 248 for the scale printing process. If the small division numeral flag SF is found not to be set (NO in step 282), and if the printing of the division numeral is not possible (NO in step 283), the process of small graduation line development control is terminated immediately.

If the count value SC is found to be greater than the scale length SL (YES in step 249), the dot pattern data on the scaling factor and those on the minimum graduation line pitch $\alpha$ are developed in the designated positions of the print buffer 148 (step 256). The dot pattern data for scale printing are read consecutively from the print buffer 148 for output to the print mechanism PM1, and the print mechanism PM1 prints the scale accordingly (step 257). Step 257 is followed by step 211 of the tape printing control process. For example, as shown in FIG. 33, the print buffer 148 contains the dot pattern data for scale printing made illustratively of a plurality of large, medium and small graduation lines LL, ML and SmL as well as division numerals 1, 2, 3, etc. It is according to these dot pattern data that the print mechanism PM1 prints the scale of the designated scaling factor onto the printing tape 105, as depicted in FIG. 34.

Figure 35:
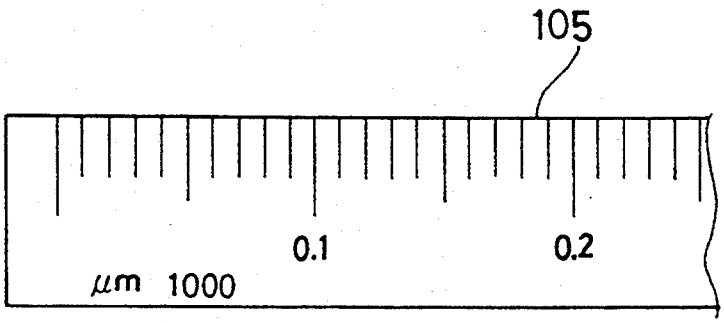
FIG. 35 is a plan view of a printing tape on which a scale has been printed with a scaling factor for magnification.

If a scaling factor of 1,000 is set in the above-described scale data setting process, a value of 0.01 $\mu$m is obtained as the minimum graduation line pitch data $\alpha$. The scale based on the scaling factor of 1,000 is then printed on the printing tape 105 as shown in FIG. 35.

As described and according to the invention, the minimum graduation line pitch of a desired scaling factor is obtained as the pitch representing the unit length of the scale. It is then possible to produce easily and inexpensively the scale of any designated scaling factor based on that minimum graduation line pitch, with graduation lines printed in an accurate and orderly manner. The minimum graduation line pitch is kept from getting too small to be practical for the scale to be printed.

The metric system adopted for printing by the embodiment above may be replaced with the English system using inches or any other measuring system. As variations of the invention, a plurality of setting items including the scale length may be displayed in a menu format, and the contents of the selected items may be displayed successively using cursor movement keys. It is not mandatory to set the three kinds of graduation lines (large, medium and small) all at once. Alternatively, any combination of the three line types, e.g., large and small, medium and small, or small only, may be selected and established as desired.

What is claimed is:

1. A scale printing apparatus, comprising:

a print body;

a tape cassette accommodation means for accommodating a tape mounted in said printer body;

input means for inputting characters, symbols and various commands;

print means including a print head for printing dot patterns onto the tape used as a printing medium;

input data storage means for storing the data representing the characters and symbols input from said input means;

display means including a display device for displaying characters and symbols;

a print buffer for accommodating dot pattern data for printout;

print control means for receiving data from said print buffer and for ordering said print means to print the received data;

data setting means for operator input of setting data about scales to include at least a scale length setting, a line pitch setting and a division number setting; and scale data generating means for receiving said setting data from said data setting means in order to generate the dot pattern data for printing at least graduation lines of a scale and to feed said dot pattern data to said print buffer.

2. The scale printing apparatus according to claim 1, wherein said scale data generating means generates the dot pattern data representing the set scale length.

3. The scale printing apparatus according to claim 1, wherein said data setting means is capable of setting the units for the lengths indicated by division numerals and of designating the print positions in which to print said units and said scale data generating means generates the dot pattern data including the data for printing the set units in the designated print positions.

4. The scale printing apparatus as claimed in claim 1, wherein the setting data input using said data setting means includes a scale start and a scale end.

5. The scale printing apparatus according to claim 1, wherein said scale data generating means is the dot pattern data representing said graduation line pitch.

6. The scale printing apparatus as claimed in claim 5, further comprising correction factor setting means for inputting a correction value based on the feed error of the tape, wherein the dot pattern data representing said graduation line pitch is corrected according to the correction value.

7. The scale printing apparatus according to claim 5, wherein said data setting means is capable of setting small, medium and large graduation line pitches of scales.

8. The scale printing apparatus according to claim 7, wherein said data setting means sets print positions of said division numbers to be printed in conjunction with any one of said small, medium and large graduation line pitches and said scale data generating means generates the dot pattern data including the data for printing said division numbers to the print positions established in conjunction with the graduation lines for which the necessity of said division numbers is designated.

9. The scale printing apparatus as claimed in claim 7, wherein said scale data generating means generates the dot pattern data representing the scaling factor.

10. The scale printing apparatus as claimed in claim 1, wherein said scale printing apparatus is used with the tape cassette which contains a tape that is provided with at least one adhesive surface.

11. A scale printing apparatus, comprising:

a print body;

a tape cassette accommodation means for accommodating a tape mounted in said printer body;

input means for inputting characters, symbols and various commands;

print means including a print head for printing dot patterns onto the tape used as a printing medium;

input data storage means for storing the data representing the characters and symbols input from said input means;

display means including a display device for displaying characters and symbols;

a print buffer for accommodating dot pattern data for printout;

print control means for receiving data from said print buffer and for ordering said print means to print the received data;

graduation line data storage means for receiving and storing beforehand the dot pattern data for printing the graduation lines of a plurality of scales, said dot pattern data corresponding to a basic length repeatable on each scale;

data setting means for operator input of a plurality of setting data about said scales to include at least a scale length setting, a line pitch setting, and a division number setting; and scale data generating means for receiving said setting data from said data setting means and for reading from said graduation line data storage means the dot pattern data corresponding to said basic length, said scale data generating means generating the dot pattern data about the graduation lines of a selected scale by combining the dot pattern data corresponding to said basic length and said setting data and supplying resultant combined dot pattern data to said print buffer.

12. The scale printing apparatus as claimed in claim 11, wherein said scale printing apparatus is used with the tape cassette which contains a tape that is provided with at least one adhesive surface.

13. A scale printing apparatus, comprising:

a print body;

a tape cassette accommodation means for accommodating a tape mounted in said printer body;

input means for inputting characters, symbols and various commands;

print means including a print head for printing dot patterns onto the tape used as a printing medium;

input data storage means for storing the data representing the characters and symbols input from said input means;

display means including a display device for displaying characters and symbols;

a print buffer for accommodating dot pattern data for printout;

print control means for receiving data from said print buffer and for ordering said print means to print the received data;

data setting means for operator input of a plurality of setting data at least including a scaling factor of a scale that defines how a graduation pitch is scaled and a scale length setting; and scale data generating means for receiving said setting data from said data setting means in order to generate the dot pattern data for printing graduation lines of the scale having the set scaling factor and to feed the dot pattern data to said print buffer.

14. The scale printing apparatus according to claim 13, wherein said scale data generating means calculates a minimum graduation line pitch in accordance with a scaling factor of said scale, said minimum graduation line pitch being greater than a predetermined integer multiple of a predetermined dot pitch and equal to the basic unit of said scale, said scale data generating means further generating the dot pattern data representing the graduation lines arranged at intervals of said minimum graduation line pitch.

15. The scale printing apparatus as claimed in claim 13, wherein the setting data further includes a scale start and a scale end.

16. The scale printing apparatus according to claim 13, wherein said data setting means is capable of setting the units for the lengths indicated by division numerals and of designating the print positions in which to print said units and said scale data generating means generates the dot pattern data including the data for printing the set units in the designated print positions.

17. The scale printing apparatus as claimed in claim 13, wherein said scale printing apparatus is used with the tape cassette which contains a tape that is provided with at least one adhesive surface.

18. The scale printing apparatus according to claim 13, wherein said data setting means is capable of setting the graduation line pitch of a scale and wherein said scale data generating means is arranged to generate the dot pattern data representing said graduation line pitch.

19. The scale printing apparatus according to claim 18, wherein said data setting means is capable of setting small, medium and large graduation line pitches of scales.

20. The scale printing apparatus according to claim 19, wherein said data setting means is capable of determining if division numerals are to be printed in conjunction with any one of said small, medium and large graduation line pitches and of setting the print positions of said division numerals and said scale data generating means generates the dot pattern data including the data for printing said division numerals to the print positions established in conjunction with the graduation lines for which the necessity of said division numerals is designated.

* * * * *